US011807010B2

(12) United States Patent
Shinoda et al.

(10) Patent No.: US 11,807,010 B2
(45) Date of Patent: Nov. 7, 2023

(54) LIQUID EJECTING APPARATUS AND MAINTENANCE METHOD OF LIQUID EJECTING APPARATUS

(71) Applicant: SEIKO EPSON CORPORATION, Tokyo (JP)

(72) Inventors: Tomoki Shinoda, Shiojiri (JP); Takeshi Iwamuro, Matsumoto (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 18/176,963

(22) Filed: Mar. 1, 2023

(65) Prior Publication Data

US 2023/0202179 A1 Jun. 29, 2023

Related U.S. Application Data

(63) Continuation of application No. 17/374,184, filed on Jul. 13, 2021, now Pat. No. 11,618,260.

(30) Foreign Application Priority Data

Jul. 16, 2020 (JP) ..... 2020-121952

(51) Int. Cl.
*B41J 2/165* (2006.01)
*B41J 2/175* (2006.01)

(52) U.S. Cl.
CPC ..... *B41J 2/16544* (2013.01); *B41J 2/17596* (2013.01); *B41J 2002/16594* (2013.01)

(58) Field of Classification Search
CPC ..... B41J 2/165; B41J 2/16544; B41J 2/175; B41J 2/17596; B41J 2002/16594
See application file for complete search history.

(56) References Cited

U.S. PATENT DOCUMENTS

| | | | | |
|---|---|---|---|---|
| 5,231,424 | A | 7/1993 | Kaneko et al. | |
| 9,944,087 | B2 * | 4/2018 | Sato | B41J 2/17509 |
| 10,780,692 | B2 | 9/2020 | Ono et al. | |
| 11,110,718 | B2 * | 9/2021 | Nakamura | B41J 2/14201 |

(Continued)

FOREIGN PATENT DOCUMENTS

| | | |
|---|---|---|
| JP | H04-211962 | 8/1992 |
| JP | 2005-028780 | 2/2005 |

(Continued)

*Primary Examiner* — An H Do
(74) *Attorney, Agent, or Firm* — WORKMAN NYDEGGER

(57) ABSTRACT

A liquid ejecting apparatus includes a liquid ejecting portion that has a supply port, a second discharge port, a plurality of nozzles, and a nozzle surface on which a plurality of the nozzles are open, and that discharges the liquid from the nozzles, a liquid supply flow path coupled to the supply port so that the liquid is supplied to the liquid ejecting portion, and a liquid return flow path coupled to the second discharge port so that the liquid supplied to the liquid ejecting portion is returned to the liquid supply flow path, in which a pressure lowering operation of lowering a pressure in the liquid ejecting portion is performed in a state where a flow of the liquid in the liquid return flow path is blocked after performing a pressurization discharge operation of pressurizing the liquid in the liquid ejecting portion and discharging the liquid from the nozzle.

8 Claims, 17 Drawing Sheets

(56) References Cited

U.S. PATENT DOCUMENTS

| | | | | |
|---|---|---|---|---|
| 11,148,433 | B2 * | 10/2021 | Otsuka | B41J 2/19 |
| 11,618,260 | B2 * | 4/2023 | Shinoda | B41J 2/18 347/33 |
| 2014/0210906 | A1 | 7/2014 | Tone | |
| 2015/0224786 | A1 | 8/2015 | Otsuka et al. | |
| 2016/0303858 | A1 | 10/2016 | Ando et al. | |
| 2017/0113465 | A1 | 4/2017 | Nakamura et al. | |
| 2020/0016893 | A1 | 1/2020 | Ono et al. | |

FOREIGN PATENT DOCUMENTS

| | | |
|---|---|---|
| JP | 2006-256024 | 9/2006 |
| JP | 2007-196623 | 8/2007 |
| JP | 2010-012637 | 1/2010 |
| JP | 2012-030496 | 2/2012 |
| JP | 2012-045810 | 3/2012 |
| JP | 2014-148072 | 8/2014 |
| JP | 2016-199021 | 12/2016 |
| JP | 2017-080892 | 5/2017 |
| JP | 2018-108741 | 7/2018 |
| JP | 2020-006598 | 1/2020 |

* cited by examiner

LIQUID EJECTING APPARATUS AND MAINTENANCE METHOD OF LIQUID EJECTING APPARATUS

This application is a continuation application of U.S. patent application Ser. No. 17/374,184, filed Jul. 13, 2021, which claims the benefit of and priority JP Application Serial Number 2020-121952, filed Jul. 16, 2020, the disclosure of which is hereby incorporated by reference herein in its entirety.

BACKGROUND

1. Technical Field

The present disclosure relates to a liquid ejecting apparatus such as a printer and a maintenance method of the liquid ejecting apparatus.

2. Related Art

In the related art, as described in JP-A-2012-30496, a liquid discharge apparatus is known, which is an example of an liquid ejecting apparatus that ejects an ink, which is an example of a liquid, supplied from a sub tank, which is an example of a liquid storage portion, via a liquid supply flow path, from a nozzle of a liquid discharge head, which is an example of a liquid ejecting portion, to print. The liquid discharge head and the sub tank are coupled to by a liquid return flow path so that the ink can be circulated, and the liquid supply flow path is provided with a purge pump, which is an example of a pressurization mechanism capable of performing a pressurization discharge operation in which the ink is forcibly supplied to the liquid discharge head and discharged from the nozzle. The liquid discharge apparatus reduces the pressure in the liquid discharge head by performing a circulation operation after performing the pressurization discharge operation.

However, as in the liquid discharge apparatus described in JP-A-2012-30496, when a pressure lowering operation of lowering the pressure in the liquid discharge head is performed by performing the circulation operation after performing the pressurization discharge operation, there is a problem that the ink remaining on a nozzle surface on which the nozzle is open due to the pressurization discharge operation flows into the liquid return flow path via the liquid discharge head in the pressure lowering operation.

SUMMARY

According to an aspect of the present disclosure, there is provided a liquid ejecting apparatus including a liquid ejecting portion that has a supply port through which a liquid flows in, a discharge port through which the liquid flows out, a common flow path communicating with the supply port and the discharge port, an individual liquid chamber communicating with the common flow path, a nozzle communicating with the individual liquid chamber, a nozzle surface on which a plurality of the nozzles are open, and a discharge element, and that discharges the liquid in the individual liquid chamber from the nozzle toward a medium by driving the discharge element; a liquid supply flow path coupled to the supply port so that the liquid is supplied to the liquid ejecting portion; a liquid return flow path coupled to the discharge port so that the liquid supplied to the liquid ejecting portion is returned to the liquid supply flow path; a pressurization mechanism that pressurizes the liquid in the liquid ejecting portion; a return valve provided in the liquid return flow path and configured to take a valve-closed state blocking a flow of the liquid and a valve-opened state allowing the flow of the liquid; and a control portion, in which the control portion performs a pressurization discharge operation of discharging the liquid from the nozzle by causing the pressurization mechanism to pressurize the liquid in the liquid ejecting portion and a pressure lowering operation of causing the pressurization mechanism to stop the pressurization in the liquid ejecting portion, and performs the pressure lowering operation in a state where the return valve is closed.

According to another aspect of the present disclosure, there is provided a maintenance method of a liquid ejecting apparatus which includes a liquid ejecting portion that has a supply port through which a liquid flows in, a discharge port through which the liquid flows out, a common flow path communicating with the supply port and the discharge port, an individual liquid chamber communicating with the common flow path, a nozzle communicating with the individual liquid chamber, a nozzle surface on which a plurality of the nozzles are open, and a discharge element, and that discharges the liquid in the individual liquid chamber from the nozzle toward a medium by driving the discharge element, a liquid supply flow path coupled to the supply port so that the liquid is supplied to the liquid ejecting portion, and a liquid return flow path coupled to the discharge port so that the liquid supplied to the liquid ejecting portion is returned to the liquid supply flow path, the method including performing a pressurization discharge operation of pressurizing the liquid in the liquid ejecting portion and discharging the liquid from the nozzle; and performing a pressure lowering operation of lowering a pressure in the liquid ejecting portion in a state where a flow of the liquid in the liquid return flow path is blocked after the pressurization discharge operation.

DESCRIPTION OF EXEMPLARY EMBODIMENTS

1. Embodiment 1

Figure 1:
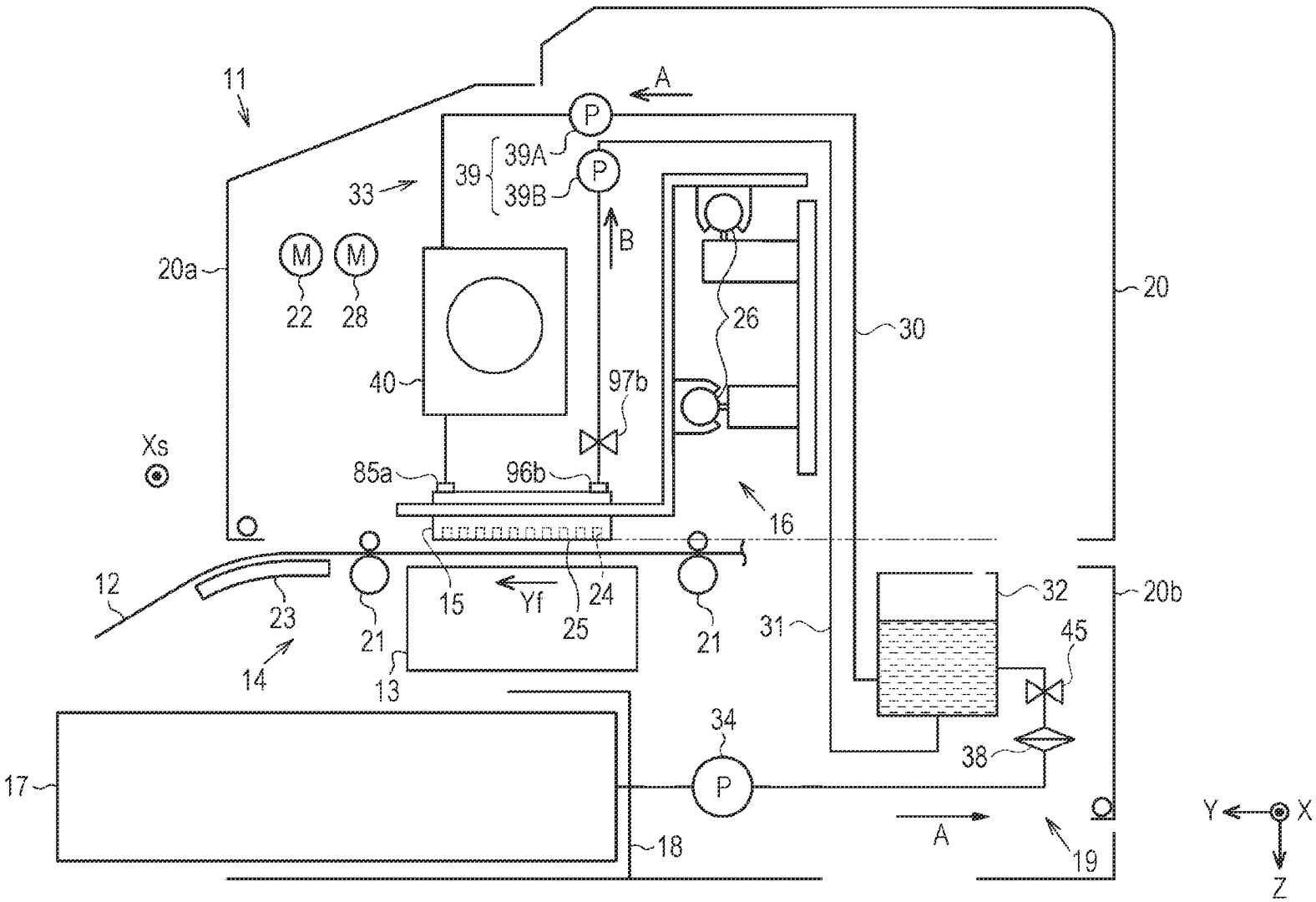
FIG. 1 is a side view schematically illustrating a liquid ejecting apparatus according to Embodiment 1.

Hereinafter, Embodiment 1 of a liquid ejecting apparatus and a maintenance method of the liquid ejecting apparatus will be described with reference to the drawings. The liquid ejecting apparatus is an ink jet printer that ejects an ink, which is an example of a liquid, onto a medium such as paper to print. In the following description, the liquid means an ink for printing, a treatment liquid that acts on the ink, and the like.

In the drawing, a direction of gravity is illustrated by the Z axis, and a direction along a horizontal plane is illustrated by the X axis and the Y axis, assuming that the liquid ejecting apparatus 11 is placed on the horizontal plane. The X axis, Y axis, and Z axis are orthogonal to each other. In the following description, a direction parallel to the Z axis is also referred to as a vertical direction Z. The liquid ejecting portion 15 in FIGS. 10, 11A, 11B, 12, 13, 15, 16, 17, and 18 is illustrated in a cross section as seen from an arrow taken along lines X, XI, XII, XIII, XV, XVI, XVII, and XVIII in FIG. 5.

As illustrated in FIG. 1, the liquid ejecting apparatus 11 is provided with a support base 13 for supporting the medium 12 and a transport portion 14 for transporting the medium 12. The liquid ejecting apparatus 11 is provided with a liquid ejecting portion 15 that ejects a liquid toward the medium 12 supported by the support base 13, and a movement mechanism 16 that can move the liquid ejecting portion 15 in a scanning direction Xs.

Figure 2:
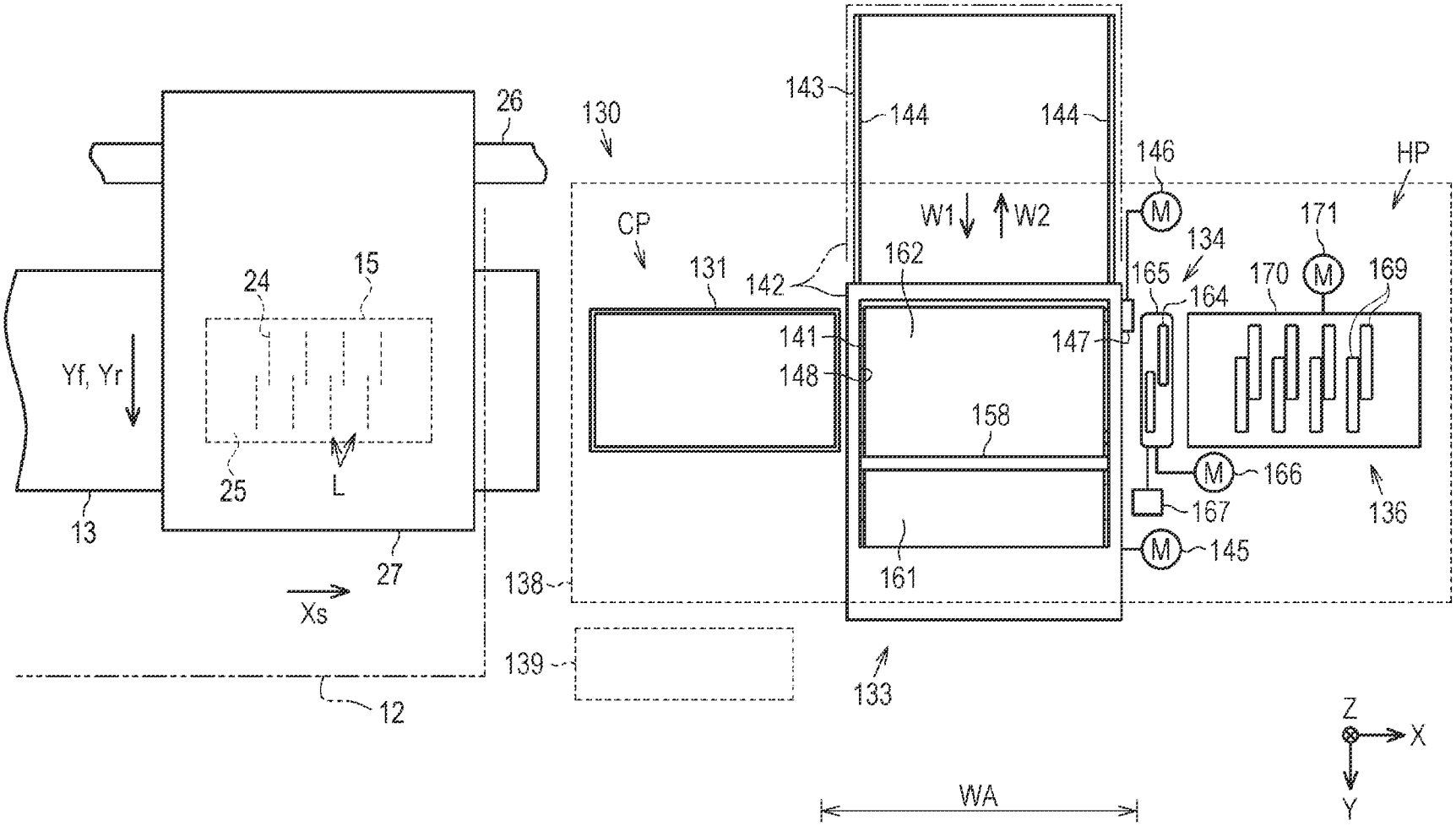
FIG. 2 is a schematic plan view of a maintenance unit.

As illustrated in FIGS. 1 and 2, the support base 13 extends in the scanning direction Xs, which is also a width direction of the medium 12, in the liquid ejecting apparatus 11. The scanning direction Xs of the present embodiment is a direction parallel to the X axis. The support base 13 supports the medium 12 located at a printing position.

The transport portion 14 is provided with a transport roller pair 21 that interposes and transports the medium 12, a transport motor 22 that rotates the transport roller pair 21, and a guide plate 23 that guides the medium 12. A plurality of transport roller pairs 21 may be provided along a transport route of the medium 12. By driving the transport motor 22, the transport portion 14 transports the medium 12 along the surface of the support base 13. The transport direction Yf where the transport portion 14 transports the medium 12 is a direction along the transport route of the medium 12, and is a direction along the surface of the support base 13 with which the medium 12 is in contact. The transport direction Yf of the present embodiment is parallel to the Y axis at the printing position.

The movement mechanism 16 is provided with a guide shaft 26 provided so as to extend in the scanning direction Xs, a carriage 27 that replaceably holds the liquid ejecting portion 15, and a carriage motor 28 that moves the carriage 27 along the guide shaft 26. The carriage 27 holds the liquid ejecting portion 15 in a posture in which the nozzle surface 25 faces the support base 13 in the vertical direction Z. For example, the liquid ejecting portion 15 ejects a plurality of types of color inks as liquids and a treatment liquid as a liquid that promotes fixing of the inks. A first cover 20*a* is provided so as to cover a portion of a moving route of the liquid ejecting portion 15. When the liquid ejecting apparatus 11 is provided so that the liquid ejecting portion 15 is exposed to the outside from the opened first cover 20*a*, the liquid ejecting portion 15 can be easily replaced.

The movement mechanism 16 reciprocates the carriage 27 and the liquid ejecting portion 15 along the guide shaft 26 in the scanning direction Xs and a direction opposite to the scanning direction Xs. That is, the liquid ejecting apparatus 11 of the present embodiment is configured as a serial type apparatus in which the liquid ejecting portion 15 reciprocates along the X axis.

As illustrated in FIG. 1, the liquid ejecting apparatus 11 of the present embodiment is provided with the liquid ejecting portion 15. The liquid ejecting portion 15 includes a supply port 85*a* into which the liquid can flow into the liquid ejecting portion 15, a second discharge port 96*b* as a discharge port from which the liquid can flow out from the liquid ejecting portion 15, a common flow path that communicates with the supply port 85*a* and the second discharge port 96*b*, a plurality of nozzles 24 that communicate with the common flow path, a nozzle surface 25 on which the plurality of the nozzles 24 are open, and a discharge element. By driving the discharge element, the liquid ejecting portion 15 of the present embodiment discharges the liquid in the vertical direction Z toward the medium 12 located at the printing position, and can print on the medium 12. The number of liquid ejecting portions 15 may be two or more. In this case, the plurality of liquid ejecting portions 15 may be disposed so as to be separated from each other by a predetermined distance in the scanning direction Xs and by a predetermined distance in the transport direction Yf.

As illustrated in FIG. 2, a plurality of nozzle rows L formed by the plurality of nozzles 24 arranged in the row direction Yr are provided on the nozzle surface 25 so as to be arranged at regular intervals in a scanning direction Xs different from the row direction Yr. The row direction Yr of the present embodiment is a direction along the nozzle surface 25 parallel to the Y axis, and coincides with the transport direction Yf at the printing position.

The liquid ejecting portion 15 of the present embodiment has four nozzle rows L. The plurality of nozzles 24 constituting one nozzle row L eject the same type of liquid. Of the plurality of nozzles 24 constituting one nozzle row L, the nozzle 24 located upstream in the transport direction Yf and the nozzle 24 located downstream in the transport direction Yf are formed so as to be displaced in the scanning direction Xs.

As illustrated in FIG. 1, the liquid ejecting apparatus 11 is provided with a mounting portion 18 on which a liquid supply source 17 for accommodating a liquid is detachably mounted, and a liquid supply portion 19 capable of supplying the liquid to the liquid ejecting portion 15. The liquid ejecting apparatus 11 is provided with a main body 20 including a housing, a frame, and the like, and the first cover 20*a* and a second cover 20*b* openably and closably attached to the main body 20.

The liquid supply source 17 is, for example, a container for containing a liquid. The liquid supply source 17 may be a replaceable cartridge or a tank that can be refilled with the liquid. The liquid ejecting apparatus 11 may be provided with a plurality of liquid supply portions 19 so as to correspond to the type of liquids ejected from the liquid ejecting portion 15. The liquid ejecting apparatus 11 of the present embodiment is provided with four liquid supply portions 19.

The liquid supply portion 19 is provided with a liquid supply flow path 30 coupled to the supply port 85*a* so that the liquid can be supplied to the liquid ejecting portion 15. The liquid supply portion 19 is provided with a liquid return flow path 31 coupled to the second discharge port 96*b* so that the liquid supplied to the liquid ejecting portion 15 can be returned to the liquid supply flow path 30, and a liquid storage portion 32 for storing the liquid. The liquid return flow path 31 can form a circulation route 33 together with the liquid supply flow path 30. The liquid storage portion 32 is coupled to the liquid supply flow path 30 and the liquid return flow path 31 to form a circulation route 33. As illustrated in FIG. 1, the liquid storage portion 32 may be an open tank that opens the space inside the liquid storage portion 32 to the atmosphere, or may be a flexible airtight bag. In addition, the liquid ejecting apparatus 11 is provided with the liquid storage portion 32 so that the position of the liquid in the liquid storage portion 32 is below the nozzle surface 25 of the liquid ejecting portion 15. Accordingly, it is possible to reduce the pressure higher than the atmospheric pressure in the liquid storage portion 32 acting on the liquid ejecting portion 15 through the liquid return flow path 31.

The liquid supply portion 19 is provided with a flow-out pump 34 that flows out the liquid from the liquid supply source 17.

The liquid supply portion 19 is provided with a filter unit 38 that captures air bubbles or a foreign matter in the liquid. The filter unit 38 captures the air bubbles and the foreign matter in the liquid. The filter unit 38 is detachably attached to the liquid supply flow path 30. When the liquid ejecting apparatus 11 is provided so that the filter unit 38 is exposed to the outside from the opened second cover 20*b*, the filter unit 38 can be easily replaced.

The liquid supply portion 19 is provided with an on-off valve 45. The on-off valve 45 is provided between the flow-out pump 34 and the liquid storage portion 32 in the liquid supply flow path 30. The on-off valve 45 is opened when the liquid flowed out by the flow-out pump 34 is supplied to the liquid ejecting portion 15.

The liquid supply portion 19 is provided with a flow mechanism 39 capable of flowing the liquid in the circulation route 33, and a pressure regulation device 40 for regulating the pressure in the liquid supplied to the liquid ejecting portion 15. The flow mechanism 39 includes a supply pump 39A as a supply-side flow mechanism provided in the liquid supply flow path 30, and a return pump 39B as a return-side flow mechanism provided in the liquid return flow path 31. The supply pump 39A causes the liquid to flow in the supply direction A from the liquid storage portion 32 toward the liquid ejecting portion 15 in the liquid supply flow path 30. The supply pump 39A can pressurize the fluid in the space communicating with the liquid supply flow path 30 in the liquid ejecting portion 15 by flowing the liquid in the supply direction A in the liquid supply flow path 30. Therefore, the supply pump 39A can be applied as a pressurization mechanism capable of pressurizing the liquid in the liquid ejecting portion 15 including the common flow path. The return pump 39B causes the liquid to flow in the return direction B from the liquid ejecting portion 15 toward the liquid storage portion 32 in the liquid return flow path 31.

The supply pump 39A may be a pump capable of flowing a liquid in the supply direction A in the liquid supply flow path 30, and may be, for example, a plunger pump or a diaphragm pump for a reciprocating pump, a gear pump or a tube pump for a rotary pump. The return pump 39B may be a pump capable of flowing a liquid in the return direction B in the liquid return flow path 31, and may be, for example, a plunger pump or a diaphragm pump for a reciprocating pump, a gear pump or a tube pump for a rotary pump.

The liquid supply portion 19 is provided with a second return valve 97*b* as a return valve in the liquid return flow path 31. The return valve is provided at a position closer to the second discharge port 96*b* of the liquid ejecting portion 15 than the return pump 39B in the liquid return flow path 31. The return valve may be in a valve-closed state where the flow of the liquid in the liquid return flow path 31 is blocked and in a valve-opened state where the flow is allowed.

As illustrated in FIG. 2, the liquid ejecting apparatus 11 is provided with a maintenance unit 130 that performs maintenance on the liquid ejecting portion 15. The maintenance unit 130 is provided in a non-printing region where the liquid ejecting portion 15 does not face the medium 12 being transported in the scanning direction Xs. The maintenance unit 130 includes a liquid receiving portion 131 for receiving the liquid discharged from the nozzle 24, a wiping mechanism 133, a suction mechanism 134, and a capping mechanism 136. The maintenance unit 130 is provided with a waste liquid pan 138 provided vertically below the moving region, which is a region where the liquid ejecting portion 15 moves, and a waste liquid storage portion 139 for storing the waste liquid discharged from the liquid ejecting portion 15.

The position above the capping mechanism 136 is a home position HP of the liquid ejecting portion 15. The home position HP is the starting point for the movement of the liquid ejecting portion 15. The region above the wiping mechanism 133 is a wiping region WA.

In the present embodiment, the position above the liquid receiving portion 131 is a discharge position CP of the liquid ejecting portion 15. When the liquid ejecting portion 15 is located at the discharge position CP, the nozzle surface 25 faces the liquid receiving portion 131. The liquid receiving portion 131 is larger than the nozzle surface 25 in the scanning direction Xs and the transport direction Yf.

The liquid ejecting apparatus 11 performs the pressurization discharge operation of pressurizing the liquid in the common flow path in the liquid ejecting portion 15 and discharging the liquid from the nozzle 24, by positioning the liquid ejecting portion 15 at the discharge position CP and driving the pressurization mechanism. That is, the liquid receiving portion 131 receives the liquid discharged by the pressurization discharge operation.

The liquid receiving portion 131 receives the liquid ejected by flushing from the nozzle 24 of the liquid ejecting portion 15. Flushing is an operation of forcibly discharging the liquid from the nozzle 24 regardless of printing by driving a discharge element 89 of the liquid ejecting portion 15 for the purpose of preventing and eliminating clogging of the nozzle 24.

The wiping mechanism 133 is provided with a strip-shaped member 141 capable of absorbing the liquid. The wiping mechanism 133 is provided with a holding portion 142 that holds the strip-shaped member 141, and a base portion 143 that movably holds the holding portion 142 in a first wiping direction W1 and a second wiping direction W2 opposite to the first wiping direction W1, and a pair of rails 144 extending along the Y axis. The wiping mechanism 133 may be provided with a wiping motor 145, a winding motor 146, and a power transmission mechanism 147 that transmits the power of the winding motor 146. The holding portion 142 has an opening 148 that exposes the strip-shaped member 141. When the strip-shaped member 141 has a width of the nozzle surface 25 or more in the scanning direction Xs, the liquid ejecting portion 15 can be efficiently maintained.

The holding portion 142 reciprocates along the Y axis on the rail 144 by the power of the wiping motor 145. Specifically, the holding portion 142 moves between a standby position illustrated by the two-dot chain line in FIG. 2 and a receiving position illustrated by the solid line in FIG. 2. When the wiping motor 145 is driven in the normal direction, the holding portion 142 moves in the first wiping direction W1 parallel to the Y axis, and moves from the standby position to the receiving position. When the wiping motor 145 is driven in the reverse direction, the holding portion 142 moves in the second wiping direction W2 opposite to the first wiping direction W1 and moves from the receiving position to the standby position. The first wiping direction W1 in the present embodiment coincides with the transport direction Yf at the printing position.

The wiping mechanism 133 can wipe the nozzle surface 25 of the liquid ejecting portion 15 located in the wiping region WA in at least one of a process in which the holding portion 142 moves in the first wiping direction W1 and a process in which the holding portion 142 moves in the second wiping direction W2. The wiping operation is maintenance in which the nozzle surface 25 is wiped by the strip-shaped member 141.

Figure 3:
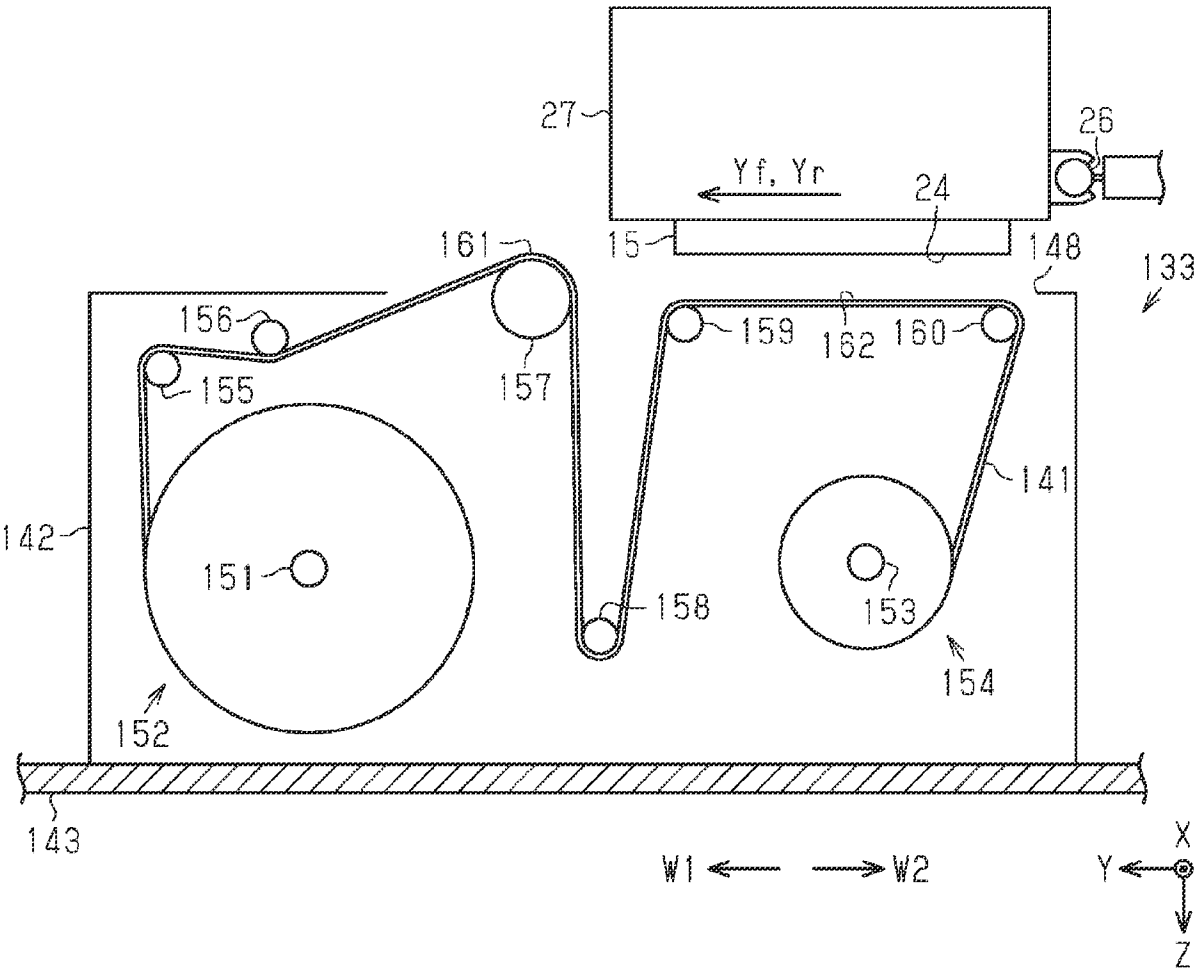
FIG. 3 is a schematic side view of a wiping mechanism.

As illustrated in FIGS. 2 and 3, the wiping mechanism 133 is provided with an unwinding portion 152 having an unwinding shaft 151 and a winding portion 154 having a winding shaft 153. The unwinding portion 152 holds the strip-shaped member 141 winded in a rolled state. The strip-shaped member 141 unwound and fed out from the unwinding portion 152 is transported to the winding portion 154 along a transport route. The wiping mechanism 133 is provided with an upstream roller 155, a tension roller 156, a pressing portion 157, a regulation roller 158, a first horizontal roller 159, and a second horizontal roller 160, which are sequentially provided along a transport route of the strip-shaped member 141 from the upstream. The holding portion 142 rotatably supports the unwinding shaft 151, the upstream roller 155, the tension roller 156, the pressing portion 157, the regulation roller 158, the first horizontal roller 159, the second horizontal roller 160, and the winding shaft 153 with the X axis as the axial direction.

The winding shaft 153 is rotated by being driven by the winding motor 146. The winding portion 154 winds the strip-shaped member 141 around the winding shaft 153 in a roll shape.

The pressing portion 157 of the present embodiment is a roller around which the strip-shaped member 141 is wound. The pressing portion 157 pushes the strip-shaped member 141 unwound from the unwinding portion 152 from the lower side to the upper side, and causes the strip-shaped member 141 to protrude from the opening 148. Of the strip-shaped member 141, the portion pushed by the pressing portion 157 is the wiping portion 161 capable of wiping the nozzle surface 25. When the holding portion 142 moves in the first wiping direction W1 or the second wiping direction W2, the pressing portion 157 brings the strip-shaped member 141 into contact with the nozzle surface 25 so that the nozzle surface 25 can be wiped. The wiping mechanism 133 of the present embodiment wipes the nozzle surface 25 when the holding portion 142 moves in the second wiping direction W2.

The wiping mechanism 133 has a drawer portion 162 formed by drawing out the strip-shaped member 141 so as to face the nozzle surface 25 in a non-contact manner. The drawer portion 162 of the present embodiment is a portion between the first horizontal roller 159 and the second horizontal roller 160. The drawer portion 162 is larger than the nozzle surface 25 in the scanning direction Xs and the transport direction Yf. The receiving position of the holding portion 142 illustrated by the solid line in FIG. 2 is a position where the liquid receiving portion 131 and the drawer portion 162 are aligned in the scanning direction Xs. When the holding portion 142 is in the receiving position, the liquid ejecting apparatus 11 may perform a pressurization discharge operation by facing the liquid ejecting portion 15 with the drawer portion 162, or may perform flushing.

As illustrated in FIG. 2, the suction mechanism 134 is provided with a suction cap 164, a suction holding body 165, a suction motor 166 that reciprocates the suction holding body 165 along the Z axis, and a pressure reducing mechanism 167 that reduces the pressure inside the suction cap 164. The suction motor 166 moves the suction cap 164 between a contact position and a retracted position. The contact position is a position where the suction cap 164 comes into contact with the liquid ejecting portion 15 and surrounds the nozzle 24. The retracted position is a position where the suction cap 164 is separated from the liquid ejecting portion 15. The suction cap 164 may be configured to surround all the nozzles 24 together, or may be configured to surround a portion of the nozzles 24.

The liquid ejecting apparatus 11 may position the liquid ejecting portion 15 above the suction mechanism 134, position the suction cap 164 at the contact position to surround one nozzle row L, and perform suction cleaning that reduces the pressure the inside of the suction cap 164 and discharges the liquid from the nozzle 24. That is, the suction mechanism 134 may receive the liquid discharged by suction cleaning.

The capping mechanism 136 includes a standby cap 169, a standby holding body 170, and a standby motor 171 that reciprocates the standby holding body 170 along the Z axis. The standby holding body 170 and the standby cap 169 move upward or downward by driving the standby motor 171. The standby cap 169 moves from a separation position, which is the lower position, to a capping position, which is the upper position, and comes into contact with the liquid ejecting portion 15 stopped at the home position HP.

The standby cap 169 located at the capping position surrounds the opening of the nozzle 24. The maintenance in which the standby cap 169 surrounds the opening of the nozzle 24 in this manner is called standby capping. Standby capping is a type of capping. The standby capping suppresses the drying of the nozzle 24. The standby cap 169 may be configured to surround all the nozzles 24 together, or may be configured to surround a portion of the nozzles 24.

Next, the liquid supply portion 19 will be described in detail.

Figure 4:
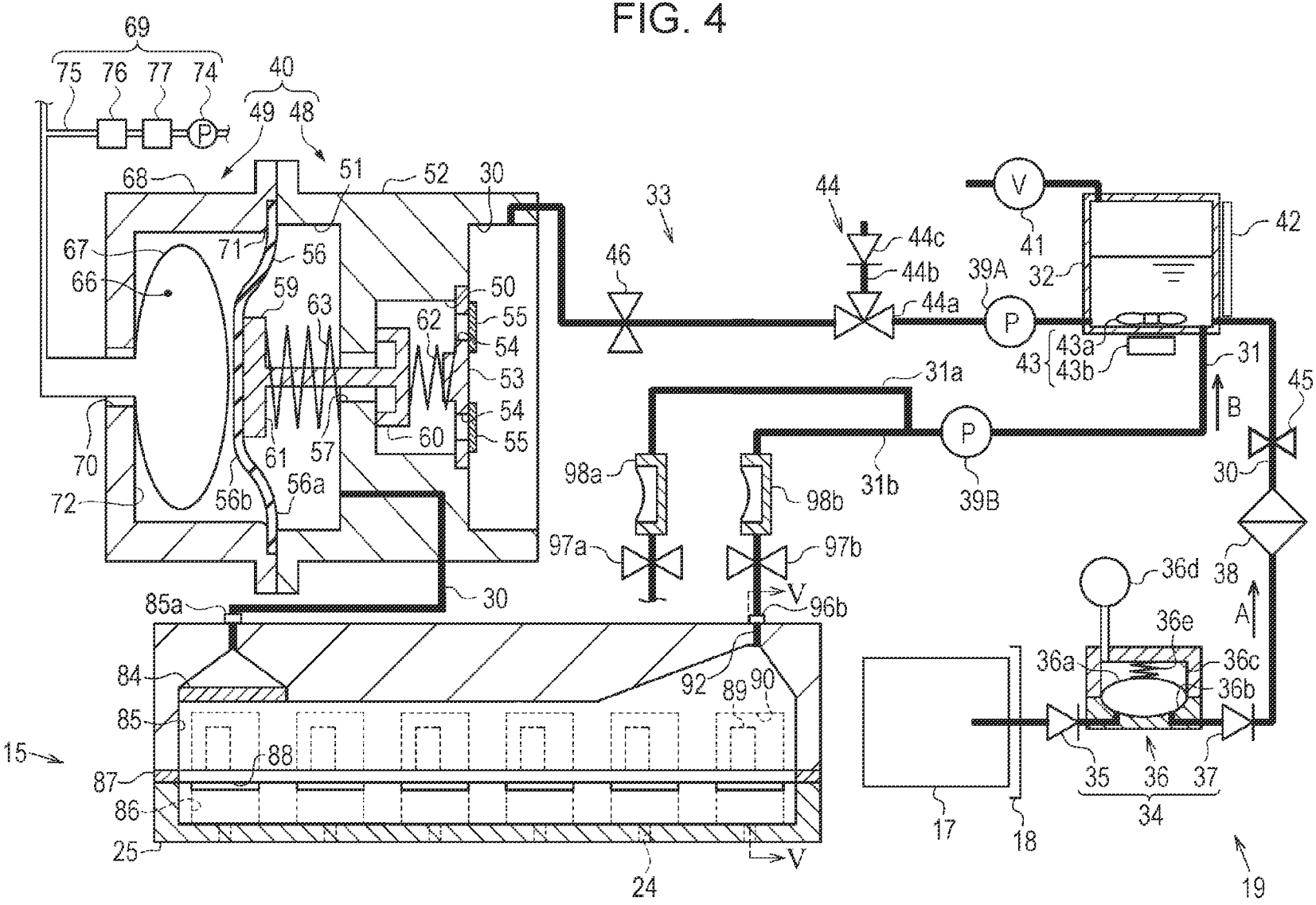
FIG. 4 is a cross-sectional view schematically illustrating a liquid ejecting portion and a liquid supply portion.

As illustrated in FIG. 4, the flow-out pump 34 has a suction valve 35, a positive displacement pump 36, and a discharge valve 37. The suction valve 35 is located upstream of the positive displacement pump 36 in the supply direction A in the liquid supply flow path 30. The discharge valve 37 is located downstream of the positive displacement pump 36 in the supply direction A in the liquid supply flow path 30. The suction valve 35 and the discharge valve 37 are configured to allow the flow of the liquid from the upstream to the downstream in the liquid supply flow path 30 and block the flow of the liquid from the downstream to the upstream. The positive displacement pump 36 included in the flow-out pump 34 includes a pump chamber 36*b* partitioned by a flexible member 36*a* and a negative pressure chamber 36*c*. The positive displacement pump 36 includes a pressure reducing portion 36*d* for reducing the pressure in the negative pressure chamber 36*c*, and a pressing member 36*e* provided in the negative pressure chamber 36*c* and pressing the flexible member 36*a* toward the pump chamber 36*b*.

The flow-out pump 34 sucks the liquid from the liquid supply source 17 through the suction valve 35 as the volume of the pump chamber 36*b* increases. The flow-out pump 34 pressurizes the liquid by pushing the liquid in the pump chamber 36*b* through the flexible member 36*a* by the pressing member 36*e*. The flow-out pump 34 discharges the liquid through the discharge valve 37 toward the liquid ejecting portion 15 as the volume of the pump chamber 36*b* decreases. The pressing force for pressurizing the liquid by the flow-out pump 34 is set to +50 kPa at a positive pressure higher than the atmospheric pressure, for example, a gauge pressure, by the pressing force of the pressing member 36*e*.

The liquid supply portion 19 is provided with a storage release valve 41 that releases the space in the liquid storage portion 32 to the atmosphere, a storage amount detection portion 42 that detects the amount of liquid stored in the liquid storage portion 32, and a stirring mechanism 43 capable of stirring the liquid in the liquid storage portion 32. The stirring mechanism 43 includes a stirring bar 43*a* provided in the liquid storage portion 32 and a rotating portion 43*b* for rotating the stirring bar 43*a*.

The liquid supply portion 19 is provided with an air intake portion 44 that takes in air into the liquid supply flow path 30. The air intake portion 44 is provided with a switching valve 44*a* provided in the liquid supply flow path 30, an air inflow path 44*b* coupled to the switching valve 44*a*, and a one-way valve 44*c* provided in the air inflow path 44*b*. The switching valve 44*a* is a three-way valve, and switches between communication and non-communication between the liquid supply flow path 30 and the air inflow path 44*b*. The one-way valve 44*c* allows the flow of air toward the liquid supply flow path 30 and blocks the flow of fluid from the liquid supply flow path 30 to the outside. When the liquid supply flow path 30 and the air inflow path 44*b* communicate with each other, air can be taken into the liquid supply flow path 30 via the air inflow path 44*b*.

The liquid supply portion 19 is provided with a choke valve 46. The choke valve 46 is closed when the choke suction is performed by reducing the pressure in the closed space including the liquid ejecting portion 15 to accumulate negative pressure in the suction cleaning by the suction mechanism 134.

Next, the pressure regulation device 40 will be described in detail.

As illustrated in FIG. 4, the pressure regulation device 40 includes a pressure adjustment mechanism 48 forming a portion of the liquid supply flow path 30, and a pressing mechanism 49 for changing the pressure regulation state of the pressure adjustment mechanism 48. The pressure adjustment mechanism 48 includes a liquid inflow portion 50 into which the liquid supplied from the liquid supply source 17 through the liquid supply flow path 30 flows in, and a main body portion 52 formed with a liquid outflow portion 51 capable of accommodating a liquid inside.

The liquid supply flow path 30 and the liquid inflow portion 50 are partitioned by a wall 53 included in the main body portion 52 and communicate with each other through a through-hole 54 formed in the wall 53. The through-hole 54 is covered with a filter member 55. Therefore, the liquid in the liquid supply flow path 30 is filtered by the filter member 55 and flows into the liquid inflow portion 50.

At least a portion of the liquid outflow portion 51 constituting the wall surface thereof includes a diaphragm 56. The diaphragm 56 receives the pressure in the liquid in the liquid outflow portion 51 on a first surface 56*a* which is an inner surface of the liquid outflow portion 51. The diaphragm 56 receives atmospheric pressure on a second surface 56*b*, which is an outer surface of the liquid outflow portion 51. Therefore, the diaphragm 56 is displaced according to the pressure in the liquid outflow portion 51. The volume of the liquid outflow portion 51 changes as the diaphragm 56 is displaced. The liquid inflow portion 50 and the liquid outflow portion 51 communicate with each other by a communication route 57.

The pressure adjustment mechanism 48 includes a supply valve 59 that can be in a valve-closed state where the liquid inflow portion 50 and the liquid outflow portion 51 are cut off in the communication route 57 to block the flow of the liquid in the liquid supply flow path 30, and a valve-opened state where the liquid inflow portion 50 and the liquid outflow portion 51 communicate with each other to allow the flow of the liquid in the liquid supply flow path 30. The supply valve 59 opens when the pressure in the liquid ejecting portion 15, for example, the pressure in the common flow path is equal to or lower than a predetermined pressure. The supply valve 59 is provided between the liquid storage portion 32 and the liquid ejecting portion 15 in the liquid supply flow path 30. The supply valve 59 illustrated in FIG. 4 is in a valve-closed state. The supply valve 59 includes a valve portion 60 capable of cutting off the communication route 57 and a pressure receiving portion 61 that receives pressure from the diaphragm 56. The supply valve 59 moves when the pressure receiving portion 61 is pushed by the diaphragm 56. The pressure receiving portion 61 may be fixed to the diaphragm 56 separately from the supply valve 59 so as to be in contact with the supply valve 59.

An upstream pressing member 62 is provided in the liquid inflow portion 50. A downstream pressing member 63 is provided in the liquid outflow portion 51. Both the upstream pressing member 62 and the downstream pressing member 63 are pressed in a direction of closing the supply valve 59. When a pressure applied to the first surface 56*a* is lower than a pressure applied to the second surface 56*b* and a difference between the pressure applied to the first surface 56*a* and the pressure applied to the second surface 56*b* is equal to or larger than a set value, the supply valve 59 changes from the valve-closed state to the valve-opened state. This set value is set in the range of, for example, 1 kPa to 2 kPa.

A pressing force of the upstream pressing member 62 and the downstream pressing member 63 is set so that the pressure in the liquid outflow portion 51 is in a negative pressure state within a range in which a recessed meniscus as a gas-liquid interface can be formed in the nozzle 24. For example, the pressing force of the upstream pressing member 62 and the downstream pressing member 63 is set so that the pressure applied to the second surface 56*b* is atmospheric pressure, and the pressure inside the liquid outflow portion 51 is in the range of −1 kPa to −2 kPa in gauge pressure in consideration of the height difference of 50 mm between the common flow path and the liquid outflow portion 51. In this case, the gas-liquid interface is the boundary where the liquid and the gas are in contact with each other, and the meniscus is the curved liquid surface formed by the liquid in contact with the nozzle 24. It is preferable that the nozzle 24 is formed with the recessed meniscus suitable for ejecting the liquid.

In the present embodiment, when the supply valve 59 is in the valve-closed state in the pressure adjustment mechanism 48, the pressure in the liquid inflow portion 50 and the pressure in the liquid upstream of the liquid inflow portion 50 are normally set to +50 kPa by the supply pump 39A at a positive pressure higher than the atmospheric pressure, for example, a gauge pressure.

In the present embodiment, when the supply valve 59 is in the valve-closed state in the pressure adjustment mechanism 48, the pressure in the liquid outflow portion 51 and the pressure in the liquid downstream of the liquid outflow portion 51 are normally a negative pressure lower than the atmospheric pressure.

When the liquid ejecting portion 15 ejects the liquid, the liquid accommodated in the liquid outflow portion 51 is supplied to the liquid ejecting portion 15 via the liquid supply flow path 30. Then, the pressure in the liquid outflow portion 51 decreases. As a result, when the difference between the pressure applied to the first surface 56*a* and the pressure applied to the second surface 56*b* of the diaphragm 56 is equal to or larger than the set value, the diaphragm 56 bends and deforms in a direction of reducing the volume of the liquid outflow portion 51. When the pressure receiving portion 61 is pressed and moved along with the deformation of the diaphragm 56, the supply valve 59 is in the valve-opened state where allows the flow of the liquid flowing from the liquid inflow portion 50 toward the liquid outflow portion 51.

When the supply valve 59 is in the valve-opened state, since the liquid in the liquid inflow portion 50 is pressurized by the supply pump 39A, the liquid is supplied from the liquid inflow portion 50 to the liquid outflow portion 51. As a result, the diaphragm 56 is deformed so as to increase the volume of the liquid outflow portion 51. When the difference between the pressure applied to the first surface 56*a* and the pressure applied to the second surface 56*b* of the diaphragm 56 is smaller than the set value, the supply valve 59 changes from the valve-opened state to the valve-closed state. As a result, the supply valve 59 blocks the flow of the liquid flowing from the liquid inflow portion 50 toward the liquid outflow portion 51.

As described above, the pressure adjustment mechanism 48 regulates the pressure in the common flow path in the liquid ejecting portion 15 by regulating the pressure in the liquid supplied to the liquid ejecting portion 15 by the displacement of the diaphragm 56.

The pressing mechanism 49 includes an expansion and contraction portion 67 forming a pressure regulation chamber 66 on the second surface 56*b* side of the diaphragm 56, a holding member 68 for holding the expansion and contraction portion 67, and a pressure regulation portion 69 that can regulate the pressure in the pressure regulation chamber 66. The expansion and contraction portion 67 is formed in a balloon shape by, for example, rubber, resin, or the like. The expansion and contraction portion 67 expands or contracts as the pressure in the pressure regulation chamber 66 is regulated by the pressure regulation portion 69. The holding member 68 is formed so as to have, for example, a bottomed cylindrical shape. A portion of the expansion and contraction portion 67 is inserted into an insertion hole 70 formed at the bottom of the holding member 68.

The holding member 68 is attached to the pressure adjustment mechanism 48 so that an opening portion 71 is closed by the pressure adjustment mechanism 48. As a result, the holding member 68 forms an air chamber 72 that covers the second surface 56*b* of the diaphragm 56. The air chamber 72 communicates with the external space through a gap between the insertion hole 70 and the expansion and contraction portion 67. Therefore, atmospheric pressure acts on the second surface 56*b* of the diaphragm 56.

The pressure regulation portion 69 expands the expansion and contraction portion 67 by regulating the pressure in the pressure regulation chamber 66 to a pressure higher than the atmospheric pressure which is the pressure in the air chamber 72. In the pressing mechanism 49, the pressure regulation portion 69 expands the expansion and contraction portion 67 to press the diaphragm 56 in a direction where the volume of the liquid outflow portion 51 is reduced. At this time, the expansion and contraction portion 67 of the pressing mechanism 49 pushes a portion of the diaphragm 56 with which the pressure receiving portion 61 is in contact, so that the supply valve 59 of the pressure adjustment mechanism 48 is forcibly in the valve-opened state. That is, the pressing mechanism 49 can be applied as a valve opening mechanism capable of opening the supply valve 59. The area of the portion of the diaphragm 56 with which the pressure receiving portion 61 is in contact is larger than the cross-sectional area of the communication route 57.

As illustrated in FIG. 4, the pressure regulation portion 69 includes, for example, a pressurization pump 74 that pressurizes a fluid such as air or water, and a coupling route 75 that couples the pressurization pump 74 and the expansion and contraction portion 67. The pressure regulation portion 69 includes a pressure detection portion 76 for detecting the pressure in the fluid in the coupling route 75, and a fluid pressure regulation portion 77 for regulating the pressure in the fluid in the coupling route 75.

The coupling routes 75 are branched into a plurality of routes, and are coupled to each of a plurality of expansion and contraction portions 67 of the pressure regulation device 40. The coupling routes 75 of the present embodiment are branched into four routes, and are coupled to each of the four expansion and contraction portions 67 of the pressure regulation device 40. The fluid pressurized by the pressurization pump 74 is supplied to each of the expansion and contraction portions 67 via the coupling route 75.

The fluid pressure regulation portion 77 may be a control valve whose opening and closing is controlled based on the pressure detected by the pressure detection portion 76, or may be a relief valve configured to automatically open the valve when the pressure in the fluid in the coupling route 75 is higher than a predetermined pressure. When the fluid pressure regulation portion 77 opens the valve, the fluid in the coupling route 75 is discharged to the outside. In this manner, the fluid pressure regulation portion 77 reduces the pressure in the fluid in the coupling route 75.

Next, the liquid ejecting portion 15 and the liquid return flow path 31 coupled to the liquid ejecting portion 15 in the present embodiment will be described in detail.

As illustrated in FIG. 4, the liquid ejecting portion 15 includes a supply port 85*a* into which the liquid can flow in the liquid ejecting portion 15. The supply port 85*a* is coupled to the liquid supply flow path 30 so that the liquid can be supplied to the liquid ejecting portion 15. The liquid ejecting portion 15 includes a common liquid chamber 85 as a common flow path communicating with the supply port 85*a*.

The height difference between the common liquid chamber 85 and the nozzle surface 25 is a level that does not need to be considered when converting the pressure. The liquid ejecting portion 15 includes a filter 84 that filters the supplied liquid, and ejects the liquid filtered by the filter 84 from the nozzle 24. The filter 84 captures the air bubbles, foreign matters, and the like in the supplied liquid. The filter 84 is provided in the common liquid chamber 85 with which the liquid supply flow path 30 communicates.

The liquid ejecting portion 15 is provided with a plurality of individual liquid chambers 86 that communicate with the common liquid chamber 85. One nozzle 24 is provided corresponding to one individual liquid chamber 86. A portion of the wall surface of the individual liquid chamber 86 is formed by the vibration plate 87. The common liquid chamber 85 and the plurality of individual liquid chambers 86 communicate with each other via a supply-side communication path 88. The plurality of nozzles 24 communicate with the common liquid chamber 85 via the corresponding individual liquid chambers 86, and are open to the nozzle surface 25. As a result, the pressure in the common liquid chamber 85 is also referred to as a rear pressure in the nozzle 24.

The liquid ejecting portion 15 is provided with a plurality of discharge elements 89 and a plurality of accommodating chambers 90 for accommodating the discharge elements 89. The accommodating chamber 90 is disposed at a position different from that of the common liquid chamber 85. One accommodating chamber 90 accommodates one discharge element 89. The discharge element 89 is provided on the surface of the vibration plate 87 opposite to the portion facing the individual liquid chamber 86. The liquid ejecting portion 15 is provided in the liquid ejecting apparatus 11 so that the liquid in the individual liquid chamber 86 can be discharged as droplets from the plurality of nozzles 24 by driving the discharge element 89.

The discharge element 89 of the present embodiment includes a piezoelectric element that contracts when a drive voltage is applied. When the vibration plate 87 is deformed due to the contraction of the discharge element due to the application of the drive voltage and then the application of the drive voltage to the discharge element 89 is released, the liquid in the individual liquid chamber 86 whose volume is changed is ejected as droplets from the nozzle 24.

Figure 5:
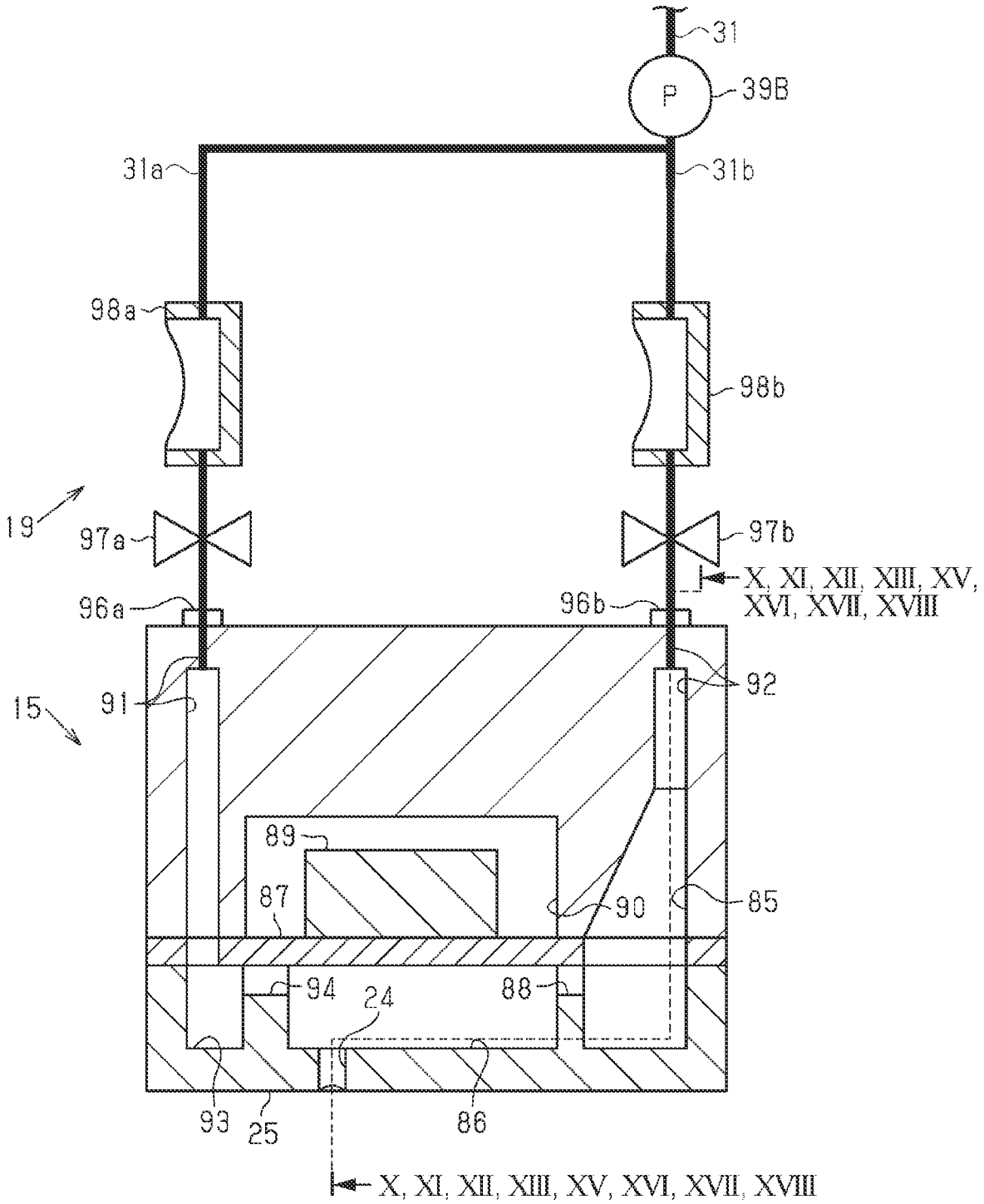
FIG. 5 is a cross-sectional view as seen from an arrow taken along line V-V in FIG. 4.

As illustrated in FIGS. 4 and 5, the liquid ejecting portion 15 includes a first discharge port 96*a* and a second discharge port 96*b* as discharge ports capable of discharging the supplied liquid to the outside without passing through the nozzle 24. The liquid ejecting portion 15 may include a first discharge flow path 91 communicating with the first discharge port 96*a*, a second discharge flow path 92 communicating with the second discharge port 96*b*, and a discharge liquid chamber 93 coupling the first discharge flow path 91 and the individual liquid chamber 86. As a result, the discharge liquid chamber 93 communicates with the first discharge port 96*a* via the first discharge flow path 91, and communicates with the supply port 85*a* via the individual liquid chamber 86 and the common liquid chamber 85. In addition, the common liquid chamber 85 communicates with the first discharge port 96*a* via the individual liquid chamber 86, the discharge liquid chamber 93, and the first discharge flow path 91, and communicates with the second discharge port 96*b* via the second discharge flow path 92.

The discharge liquid chamber 93 communicates with a plurality of individual liquid chambers 86 via a discharge side communication path 94 provided for each individual liquid chamber 86. By providing the discharge liquid chamber 93, it is sufficient to provide one first discharge flow path 91 for the plurality of individual liquid chambers 86. That is, by providing the discharge liquid chamber 93, it is not necessary to provide the first discharge flow path 91 for each individual liquid chamber 86. As a result, the configuration of the liquid ejecting portion 15 can be simplified. The liquid ejecting portion 15 may include a plurality of first discharge flow paths 91 communicating with the plurality of individual liquid chambers 86.

As illustrated in FIGS. 4 and 5, the liquid return flow path 31 includes a first return flow path 31*a* coupled to the first discharge port 96*a* and a second return flow path 31*b* coupled to the second discharge port 96*b* so that the liquid supplied to the liquid ejecting portion 15 can be returned to the liquid supply flow path 30. The liquid return flow path 31 of the present embodiment is configured so that the first return flow path 31*a* and the second return flow path 31*b* merge. In the liquid return flow path 31, the first return flow path 31*a* and the second return flow path 31*b* may not merge, and each of the first return flow path 31*a* and the second return flow path 31*b* may be coupled to the liquid storage portion 32.

The first return flow path 31*a* is provided with a first return valve 97*a* as a return valve and a first damper 98*a*. The second return flow path 31*b* is provided with a second return valve 97*b* as a return valve and a second damper 98*b*. The return pumps 39B may be provided in each of the first return flow path 31*a* and the second return flow path 31*b*.

In the first return flow path 31*a*, the first damper 98*a* is provided at a position closer to the return pump 39B than the first return valve 97*a*. In the second return flow path 31*b*, the second damper 98*b* is provided at a position closer to the return pump 39B than the second return valve 97*b*. The first damper 98*a* and the second damper 98*b* are configured to store the liquid. For example, one surfaces of the first damper 98*a* and the second damper 98*b* are formed of a flexible film, and the volume for storing the liquid is variable. By providing the first damper 98*a* and the second damper 98*b*, it is possible to suppress the fluctuation of the pressure generated in the liquid ejecting portion 15 when the liquid flows through the first return flow path 31*a* and the second return flow path 31*b*.

The liquid supply portion 19 can flow the liquid in any flow path of the first return flow path 31*a* and the second return flow path 31*b* as the liquid return flow path 31 by opening and closing the first return valve 97*a* and the second return valve 97*b* as the return valve. For example, by opening the first return valve 97*a* as the return valve and driving the return pump 39B, the liquid in the common flow path of the liquid ejecting portion 15 can be discharged from the first discharge port 96*a* as a discharge port to the first return flow path 31*a* as the liquid return flow path 31. In addition, for example, by opening the second return valve 97*b* as the return valve and driving the return pump 39B, the liquid in the common flow path of the liquid ejecting portion 15 can be discharged from the second discharge port 96*b* as a discharge port to the second return flow path 31*b* as the liquid return flow path 31.

When the liquid in the common liquid chamber 85 as the common flow path is discharged to the liquid return flow path 31, the pressure in the common liquid chamber 85 of the liquid ejecting portion 15 decreases, and the liquid accommodated in the liquid outflow portion 51 of the pressure adjustment mechanism 48 is supplied to the common liquid chamber 85 of the liquid ejecting portion 15 via the liquid supply flow path 30. Then, the pressure in the liquid outflow portion 51 decreases. As a result, when the difference between the pressure applied to the first surface 56*a* and the pressure applied to the second surface 56*b* of the diaphragm 56 is equal to or larger than the set value, the supply valve 59 is in a valve-opened state where allows the flow of the liquid flowing from the liquid inflow portion 50 toward the liquid outflow portion 51. As a result, the liquid supplied from the liquid supply flow path 30 to the liquid ejecting portion 15 via the liquid inflow portion 50 is returned to the liquid supply flow path 30 via the liquid return flow path 31 and the liquid storage portion 32.

In addition, when the suction mechanism 134 performs choke suction, the first return valve 97*a* and the second return valve 97*b* are closed together with the choke valve 46 to make the inside of the liquid supply flow path 30 from the choke valve 46 to the liquid ejecting portion 15, the inside of the liquid return flow path 31 from the liquid ejecting portion 15 to the return valve, and the inside of the liquid ejecting portion 15 closed spaces.

Next, the electrical configuration of the liquid ejecting apparatus 11 will be described.

Figure 6:
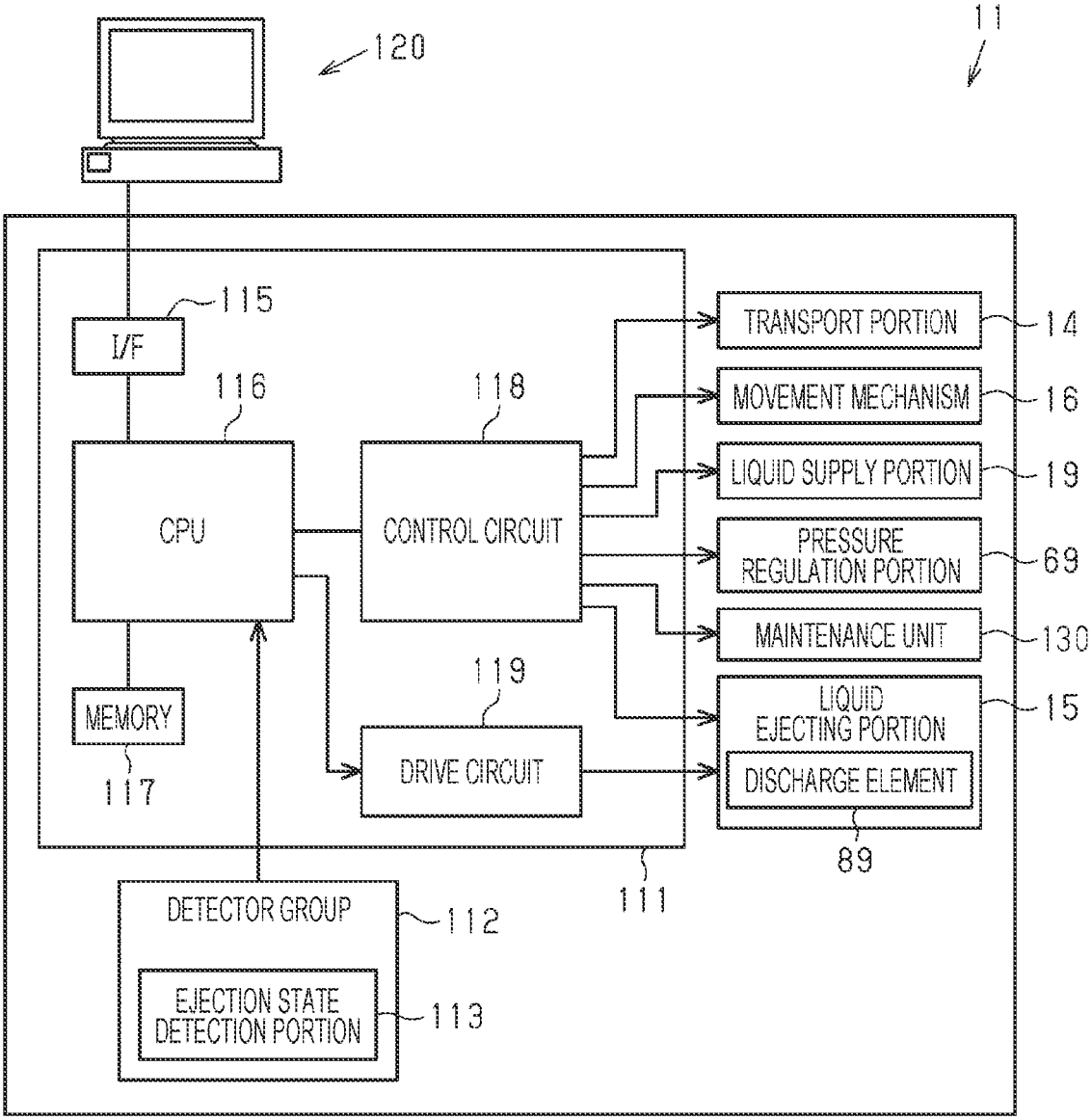
FIG. 6 is a block diagram illustrating an electrical configuration of the liquid ejecting apparatus.

As illustrated in FIG. 6, the liquid ejecting apparatus 11 is provided with a control portion 111 that comprehensively controls the components of the liquid ejecting apparatus 11, and a detector group 112 that is controlled by the control portion 111. The detector group 112 includes an ejection state detection portion 113 capable of detecting the liquid ejection state of the liquid ejecting portion 15 by detecting the vibration waveform of the individual liquid chamber 86. The detector group 112 monitors the situation in the liquid ejecting apparatus 11. The detector group 112 outputs the detection result to the control portion 111.

The control portion 111 includes an interface portion 115, a CPU 116, a memory 117, a control circuit 118, and a drive circuit 119. The interface portion 115 transmits and receives data between the computer 120, which is an external device, and the liquid ejecting apparatus 11. The drive circuit 119 generates a drive signal for driving the discharge element 89.

The CPU 116 is an arithmetic processing device. The memory 117 is a storage device that secures a region for storing the program of the CPU 116 or a work region, and includes a storage element such as a RAM or an EEPROM. According to the program stored in the memory 117, the CPU 116 controls the transport portion 14, the movement mechanism 16, the liquid supply portion 19, the pressure regulation portion 69, the maintenance unit 130, and the liquid ejecting portion 15 of the liquid ejecting apparatus 11 via the control circuit 118.

The detector group 112 may include, for example, a linear encoder that detects the movement status of the carriage 27, and a medium detection sensor that detects the medium 12. The ejection state detection portion 113 may be a circuit for detecting the residual vibration of the individual liquid chamber 86. The ejection state detection portion 113 may include a piezoelectric element constituting the discharge element 89.

Next, a method of estimating the state in the individual liquid chamber 86 based on the detection result of the ejection state detection portion 113 will be described.

When a voltage is applied to the discharge element 89 by a signal from the drive circuit 119, the vibration plate 87 bends and deforms. As a result, pressure fluctuation occurs in the individual liquid chamber 86. Due to the fluctuation, the vibration plate 87 vibrates for a while. This vibration is referred to as a residual vibration. From the state of the residual vibration, it is possible to estimate the state of the range including the individual liquid chamber 86 and the nozzle 24 communicating with the individual liquid chamber 86.

Figure 7:
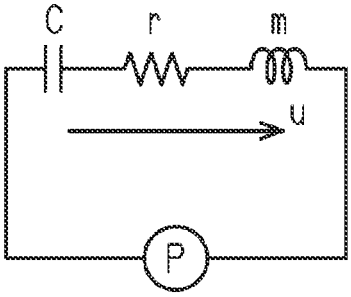
FIG. 7 is a diagram illustrating a calculation model of simple vibration assuming residual vibration of a vibration plate.

FIG. 7 is a diagram illustrating a calculation model of simple vibration assuming the residual vibration of the vibration plate 87.

When the drive circuit 119 applies a drive signal to the discharge element 89, the discharge element 89 expands and contracts according to the voltage of the drive signal. The vibration plate 87 bends according to the expansion and contraction of the discharge element 89. As a result, the volume of the individual liquid chamber 86 expands and then contracts. At this time, due to the pressure generated in the individual liquid chamber 86, a portion of the liquid filling the individual liquid chamber 86 is ejected as droplets from the nozzle 24.

During the series of operations of the vibration plate 87 described above, the vibration plate 87 freely vibrates at the natural vibration frequency determined by the flow path resistance r due to the shape of the flow path through which the liquid flows and the viscosity of the liquid, the inertia m due to the weight of the liquid in the flow path, and the compliance C of the vibration plate 87. The free vibration of the vibration plate 87 is the residual vibration.

The calculation model of the residual vibration of the vibration plate 87 illustrated in FIG. 7 can be represented by the pressure P, the above-described inertia m, the compliance C, and the flow path resistance r. When the step response when the pressure P is applied to the circuit of FIG. 7 is calculated for the volume velocity u, the following equation is obtained.

Figure 8:
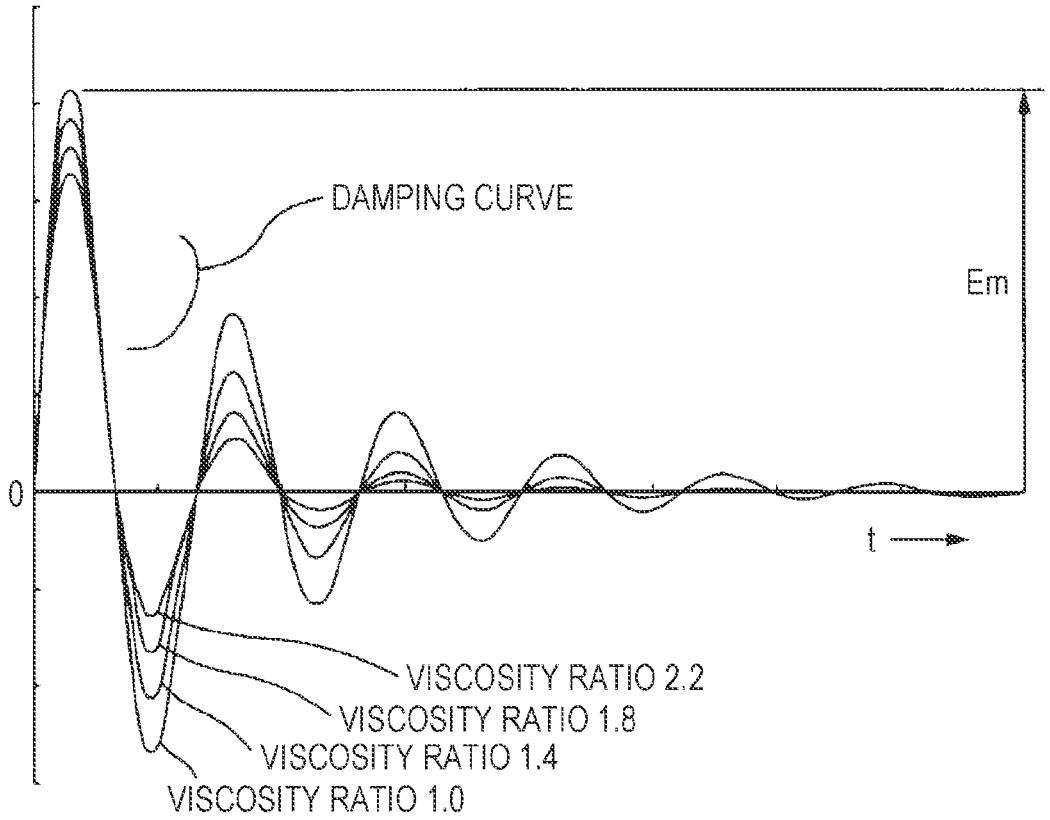
FIG. 8 is a graph for describing a relationship between thickening of a liquid and a residual vibration waveform.

FIG. 8 is a graph for describing a relationship between thickening of a liquid and a residual vibration waveform. The horizontal axis of FIG. 8 indicates the time t, and the vertical axis indicates the magnitude of the residual vibration. Em in FIG. 8 is a peak value of a first half wave in the residual vibration waveform. For example, when the liquid near the nozzle 24 dries, the viscosity of the liquid increases, that is, thickens. When the liquid thickens, the flow path resistance r increases, so that the vibration cycle and the damping of the residual vibration increases.

Figure 9:
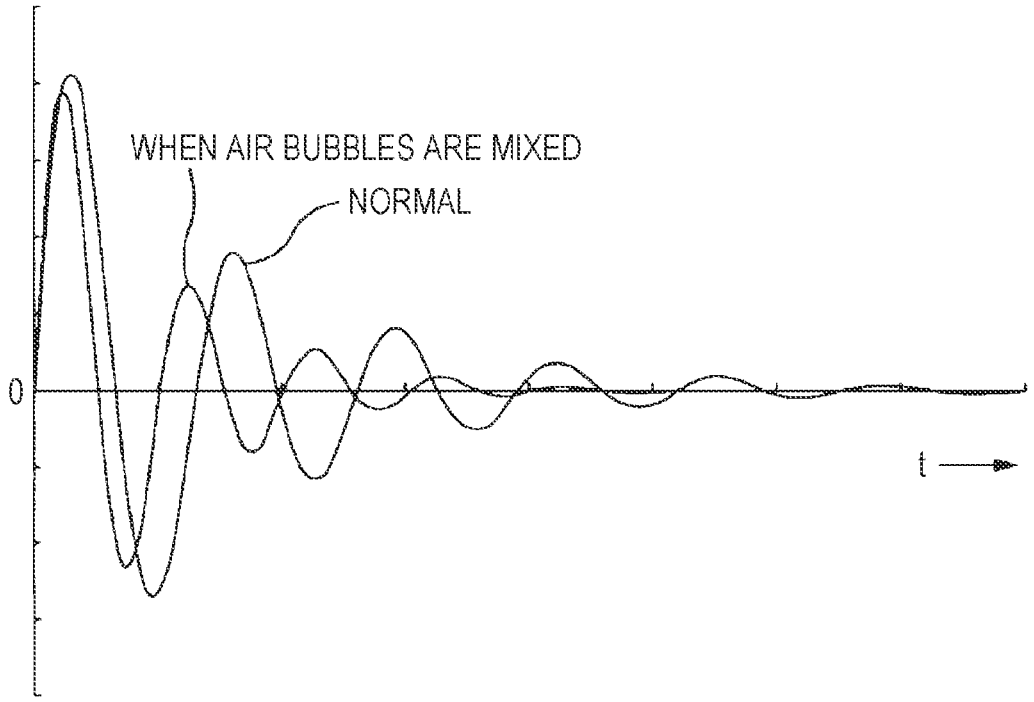
FIG. 9 is a graph for describing a relationship between mixing of air bubbles and a residual vibration waveform.

FIG. 9 is a graph for describing of a relationship between mixing of air bubbles and a residual vibration waveform. The horizontal axis of FIG. 9 indicates the time t, and the vertical axis indicates the magnitude of the residual vibration. For example, when the air bubbles are mixed in the flow path of the liquid or the tip end of the nozzle 24, the inertia m, which is the weight of the liquid, is reduced by the amount of the air bubbles mixed in, as compared with the case where the state of the nozzle 24 is normal. When m decreases from the equation (2), the angular velocity ω increases, so that the vibration cycle becomes shorter. That is, the vibration frequency becomes high.

The case where the air bubbles are mixed in the individual liquid chamber 86 includes the case where the air bubbles are mixed in the region including the nozzle 24 in addition to the individual liquid chamber 86.

In addition, for example, a frequency of the vibration waveform detected in a state where the air bubbles are present in the individual liquid chamber 86 and the nozzle 24 filled with the liquid is higher than a frequency of the vibration waveform detected in a state where the air bubbles are not present in the individual liquid chamber 86 and the nozzle 24 filled with the liquid. A frequency of the vibration waveform detected in a state where the individual liquid chamber 86 and the nozzle 24 are filled with air is higher than the frequency of the vibration waveform detected in the state where the air bubbles are present in the individual liquid chamber 86 and the nozzle 24 filled with the liquid. The larger the size of the air bubbles existing in the individual liquid chamber 86 and the nozzle 24 filled with the liquid, the higher the frequency of the vibration waveform.

On the other hand, for example, when a liquid adheres to the nozzle surface 25 and the liquid adhering to the nozzle surface 25 communicates with the liquid in the nozzle 24, the liquid adhering to the nozzle surface 25 communicates with the liquid filled in the individual liquid chamber 86 via the nozzle 24. Therefore, it is considered that the weight of the liquid, that is, the inertia m is increased by increasing the amount of liquid adhering to the nozzle surface 25 when viewed from the vibration plate 87 as compared with the normal state. Therefore, when the liquid adhering to the nozzle surface 25 is coupled to the liquid in the individual liquid chamber 86, the frequency is lower than the frequency in the normal state.

In addition, when foreign matter such as paper dust adheres to the vicinity of the opening of the nozzle 24, it is considered that the inertia m increases because the amount of liquid in the individual liquid chamber 86 and the amount of exuded liquid increases than the normal state when viewed from the vibration plate 87. It is considered that the flow path resistance r is increased by the fibers of the paper dust adhering to the vicinity of the outlet of the nozzle 24. Therefore, when the paper dust adheres to the vicinity of the opening of the nozzle 24, the frequency is lower than that at the time of normal ejection, and the frequency of the residual vibration is higher than that in a case in which the liquid is thickened.

When the liquid is thickened, the air bubbles are mixed in, or foreign matter is stuck, the state in the nozzle 24 and the individual liquid chamber 86 becomes abnormal, so that the liquid is typically not ejected from the nozzle 24. Therefore, missing dots occur in the image recorded on the medium 12. Even when the droplets are ejected from the nozzle 24, the amount of the droplets may be small, or the flight direction of the droplets may deviate and the droplets may not land at the target position. The nozzle 24 in which such ejection failure occurs is referred to as an abnormal nozzle.

As described above, the residual vibration of the individual liquid chamber 86 communicating with the abnormal nozzle is different from the residual vibration of the individual liquid chamber 86 communicating with the normal nozzle 24. Therefore, the ejection state detection portion 113 detects the vibration waveform of the individual liquid chamber 86. The control portion 111 estimates the state of the range including the individual liquid chamber 86 and the nozzle 24 communicating with the individual liquid chamber 86, based on the detection result of the ejection state detection portion 113.

The control portion 111 estimates whether the ejection state of the liquid ejecting portion 15 is normal or abnormal based on the vibration waveform of the individual liquid chamber 86, which is the detection result of the ejection state detection portion 113. When the state in the individual liquid chamber 86 is abnormal, the nozzle 24 communicating with the individual liquid chamber 86 is estimated to be an abnormal nozzle. The control portion 111 estimates whether the state in the individual liquid chamber 86 is abnormal due to the presence of air bubbles or the state in the individual liquid chamber 86 is abnormal due to the thickening of the liquid, based on the vibration waveform of the individual liquid chamber 86. The control portion 111 estimates the total volume of air bubbles existing in the individual liquid chamber 86 and the nozzle 24 communicating with the individual liquid chamber 86, and the degree of thickening of the liquid in the nozzle 24 communicating with the individual liquid chamber 86 and the individual liquid chamber 86, based on the vibration waveform of the individual liquid chamber 86. The control portion 111 estimates whether or not the liquid adheres to the nozzle surface 25 and the liquid adhering to the nozzle surface 25 communicates with the liquid in the nozzle 24 based on the vibration waveform of the individual liquid chamber 86.

The control portion 111 may estimate whether or not the filter 84 is normal from the detection result detected by the ejection state detection portion 113. When the filter 84 is clogged, the flow of the liquid passing through the filter 84 is likely to be stagnant. When the flow of the liquid is stagnant, air enters from the nozzle 24, and the air bubbles are likely to accumulate in the individual liquid chamber 86. Therefore, the control portion 111 estimates that the filter 84 has an abnormality based on the detected abnormality due to the air bubbles in the individual liquid chamber 86.

Specifically, for example, the control portion 111 estimates that the filter 84 has an abnormality when an abnormality occurs due to the air bubbles in a predetermined number or more of the individual liquid chambers 86 among the plurality of individual liquid chambers 86. The predetermined number is, for example, a number that cannot be handled by complementary printing in which the liquid to be ejected from the abnormal nozzle is supplemented by the liquid ejected from the surrounding nozzles 24.

In the present embodiment, the control portion 111 performs a printing operation of forming characters and images on the medium 12, by alternately performing a transport operation that drives the transport portion 14 to transport the medium 12 by the unit transport amount and an ejection operation of discharging the liquid from the liquid ejecting portion 15 toward the medium 12 while moving the carriage 27 in the scanning direction Xs.

In addition, the control portion 111 drives the pressurization pump 74 in the pressing mechanism 49 to supply the pressurized fluid to the expansion and contraction portion 67. As a result of the expansion and contraction portion 67 expanding in this manner, the diaphragm 56 is displaced in the direction of reducing the volume of the liquid outflow portion 51, and the supply valve 59 is in the valve-opened state. In this manner, the control portion 111 controls the opening and closing of the supply valve 59 based on the drive of the pressing mechanism 49.

In the liquid ejecting apparatus 11, when the flow of the liquid is stagnant, the liquid is likely to thicken or the air bubbles are likely to accumulate. In this case, an abnormal nozzle is likely to occur. That is, the states in the individual liquid chamber 86 and the nozzle 24 are likely to be abnormal. Therefore, the control portion 111 is configured to perform a maintenance operation of maintaining the liquid ejecting portion 15 in order to suppress thickening of the liquid or discharge the air bubbles. The control portion 111 of the present embodiment is configured to perform a first discharge operation, a second discharge operation, a third discharge operation, a fourth discharge operation, a fifth discharge operation, a pressurization discharge operation, and a suction cleaning as the maintenance operation of the liquid ejecting portion 15.

When the liquid is not ejected from the nozzle 24 in the printing operation, the control portion 111 performs the first discharge operation of discharging the liquid in the individual liquid chamber 86 toward the liquid return flow path 31 via the first discharge flow path 91 communicating with the individual liquid chamber 86 as the maintenance operation of the liquid ejecting portion 15. The first discharge operation is an operation of discharging the liquid in the individual liquid chamber 86 toward the liquid return flow path 31 via the first discharge flow path 91 and the first discharge port 96*a*.

The time when the liquid is not ejected from the nozzle 24 in the printing operation is, for example, a return time of the carriage 27 or a time between the pages of the medium 12. The return time of the carriage 27 is a timing at which the carriage 27 moves so as to return to the home position HP. The time between the pages of the medium 12 is a timing from when the image is printed on the medium 12 until the next medium 12 reaches a position facing the liquid ejecting portion 15. The control portion 111 performs the first discharge operation at such a timing.

In the first discharge operation, the control portion 111 causes the liquid to be discharged toward the liquid return flow path 31, by sucking the liquid in the individual liquid chamber 86 from the first discharge flow path 91 side so as to maintain the meniscus at the gas-liquid interface in the nozzle 24. The control portion 111 of the present embodiment performs the first discharge operation by driving the return pump 39B with the first return valve 97*a* opened. When the first discharge operation is performed by sucking the liquid in the individual liquid chamber 86 from the first discharge flow path 91 side, the gas-liquid interface of the meniscus in the nozzle 24 moves toward the individual liquid chamber 86 side. As a result, at least a portion of the liquid in the nozzle 24 flows. As a result, thickening of the liquid in the nozzle 24 can be suppressed.

the control portion 111 may perform the first discharge operation when it is estimated that the state in the individual liquid chamber 86 is abnormal because the air bubbles existing in the individual liquid chamber 86 and the nozzle 24 have a volume equal to or larger than the set value based on the detection result of the ejection state detection portion 113. The set value is stored in the memory 117 of the control portion 111. The memory 117 stores, for example, a vibration waveform detected by the ejection state detection portion 113 when the air bubbles existing in the individual liquid chamber 86 and the nozzle 24 have a volume that is a set value.

The control portion 111 estimates whether or not the state in the individual liquid chamber 86 is improved by comparing the vibration waveforms of the individual liquid chamber 86 detected by the ejection state detection portion 113 with a time interval therebetween, and performs the second discharge operation of discharging the liquid in the individual liquid chamber 86 from the nozzle 24 to the outside as the maintenance operation of the liquid ejecting portion 15, when it is estimated that the condition in the individual liquid chamber 86 is not improved. The second discharge operation is the flushing described above.

For example, when the state in the individual liquid chamber 86 is not improved even when the first discharge operation is performed, the control portion 111 performs the second discharge operation of discharging the liquid in the individual liquid chamber 86 from the nozzle 24 to the outside. In this case, the control portion 111 performs the first discharge operation based on the detection result of the ejection state detection portion 113, and then again detects the state in the individual liquid chamber 86 by the ejection state detection portion 113. At this time, when it is estimated that the volume of the air bubbles in the individual liquid chamber 86 and the nozzle 24 is large or the thickening of the liquid progresses based on the vibration waveform of the individual liquid chamber 86, the control portion 111 performs the second discharge operation on the assumption that the state in the individual liquid chamber 86 is not improved.

For example, the control portion 111 may not perform the first discharge operation based on the volume of air bubbles existing in the individual liquid chamber 86 and the nozzle 24 being less than the set value, and may perform the second discharge operation when the condition in the individual liquid chamber 86 is not improved even though the time expected for the air bubbles to disappear is passed.

When the number of individual liquid chambers 86, in which it is estimated that the state inside the individual liquid chambers 86 is abnormal due to the air bubbles existing in the individual liquid chambers 86 and the nozzle 24, is equal to or greater than the set number based on the detection result of the ejection state detection portion 113, the control portion 111 performs the third discharge operation of discharging the liquid in the common liquid chamber 85 toward the liquid return flow path 31 via the second discharge flow path 92 coupled to the common liquid chamber 85 and the second discharge port 96*b*, as the maintenance operation of the liquid ejecting portion 15. In the present embodiment, the third discharge operation is performed before the first discharge operation is performed. The control portion 111 performs the third discharge operation by driving the return pump 39B with the second return valve 97*b* opened. The set number is stored in the memory 117 of the control portion 111.

When the number of individual liquid chambers 86, in which it is estimated that the state inside the individual liquid chambers 86 is abnormal due to the air bubbles existing in the individual liquid chambers 86 and the nozzle 24, is equal to or greater than the set number, it is considered that the air bubbles are present in the common liquid chamber 85 communicating with the plurality of individual liquid chambers 86. In this case, since there is a possibility that abnormal nozzles are continuously generated on the nozzle surface 25, it is difficult to perform complementary printing. Therefore, when the number of the individual liquid chambers 86, in which it is estimated that the state inside the individual liquid chambers 86 is abnormal due to the air bubbles existing in the individual liquid chambers 86 and the nozzle 24, is equal to or greater than the set number, the liquid ejecting portion the third discharge operation is performed as the maintenance operation of the liquid ejecting portion 15. As a result, the liquid in the common liquid chamber 85 in which the air bubbles are considered to be present can be discharged. In the present embodiment, the air bubbles in the liquid discharged from the liquid ejecting portion 15 are released from the liquid into the air in the liquid storage portion 32 when circulating in the circulation route 33.

When the liquid is ejected from the nozzle 24 in the printing operation, the control portion 111 performs the fourth discharge operation of discharging the liquid in the individual liquid chamber 86 toward the liquid return flow path 31 via the first discharge flow path 91 communicating with the individual liquid chamber 86 at a flow rate smaller than that of the first discharge operation as the maintenance operation of the liquid ejecting portion 15. In the present embodiment, the control portion 111 performs the fourth discharge operation by driving the return pump 39B with the first return valve 97*a* opened. The time when the liquid is ejected from the nozzle 24 in the printing operation is, for example, the timing when an image is printed on the medium 12.

In the fourth discharge operation, the flow rate of the liquid flowing from the individual liquid chamber 86 toward the liquid return flow path 31 is smaller than that in the first discharge operation, so that the pressure in the individual liquid chamber 86 does not fluctuate significantly. By performing the fourth discharge operation, even when the liquid is ejected from the nozzle 24 in the printing operation, it is possible to suppress the thickening of the liquid while suppressing the fluctuation of the pressure in the individual liquid chamber 86. The flow rate of the liquid is the volume of the liquid flowing per unit time.

When the printing operation is not performed, the control portion 111 performs the fifth discharge operation of discharging the liquid in the individual liquid chamber 86 toward the liquid return flow path 31 via the first discharge flow path 91 communicating with the individual liquid chamber 86 at a flow rate larger than that of the first discharge operation as the maintenance operation of the liquid ejecting portion 15. In the present embodiment, the control portion 111 performs the fifth discharge operation by driving the return pump 39B with the first return valve 97*a* opened. The fifth discharge operation is an operation of discharging the liquid in the individual liquid chamber 86 toward the liquid return flow path 31 via the first discharge flow path 91 and the first discharge port 96*a* at a flow rate larger than that of the first discharge operation in a state where the nozzle surface 25 is capped by the suction cap 164.

When the inside of the individual liquid chamber 86 is sucked from the liquid return flow path 31 side and the flow rate of the liquid flowing from the individual liquid chamber 86 toward the liquid return flow path 31 is increased, the outside air may be drawn from the nozzle 24. On the other hand, when the liquid in the individual liquid chamber 86 is discharged toward the liquid return flow path 31 via either the first discharge flow path 91 or the second discharge flow path 92 coupled to the individual liquid chamber 86, and the nozzle surface 25 is capped by the suction cap 164, it is possible to prevent outside air from entering the individual liquid chamber 86 through the nozzle 24.

For the reasons described above, in the state where the nozzle surface 25 is capped by the suction cap 164, the flow rate of the liquid discharged from the individual liquid chamber 86 toward the liquid return flow path 31 via the first discharge flow path 91 coupled to the individual liquid chamber 86 can be increased. Therefore, by performing the fifth discharge operation, the liquid ejecting portion 15 can be maintained more effectively. When the suction cap 164 includes an atmospheric release valve, the fifth discharge operation is performed with the atmospheric release valve closed.

When a circulation operation such as the first discharge operation, the third discharge operation, the fourth discharge operation, and the fifth discharge operation is performed, or when the return valve is opened to perform the circulation operation, even in the capping state as in the fifth discharge operation, the pressure fluctuates due to the flow of the liquid in the common liquid chamber 85 and the individual liquid chamber 86. In addition, when the circulation operation is performed by driving the return pump 39B as in the first discharge operation, the third discharge operation, the fourth discharge operation, and the fifth discharge operation, the pressure in the common liquid chamber 85 and the individual liquid chamber 86 decreases. Therefore, it is preferable that the first discharge operation, the third discharge operation, the fourth discharge operation, and the fifth discharge operation are started in a state where a meniscus is formed in the nozzle 24, and preferably in a state where a recessed meniscus is formed in the nozzle 24, so that the liquid or air adhering to the nozzle surface 25 is prevented from flowing into the liquid return flow path 31 via the nozzle 24 by performing the circulation operation.

In addition, when the first discharge operation, the third discharge operation, the fourth discharge operation, and the fifth discharge operation are completed, it is preferable that the control portion 111 stops the drive of the return pump 39B so that the flow rate of the liquid flowing from the inside of the liquid ejecting portion 15 toward the liquid return flow path 31 gradually decreases. In addition, even in the circulation operation performed by driving the return pump 39B, such as the first discharge operation, the third discharge operation, the fourth discharge operation, and the fifth discharge operation, when the return valve is suddenly closed to block the flow of the liquid from the inside of the liquid ejecting portion 15 toward the liquid return flow path 31, the pressure in the common liquid chamber 85 or the individual liquid chamber 86 may increase Therefore, when the first discharge operation, the third discharge operation, the fourth discharge operation, and the fifth discharge operation are completed, it is preferable to slowly close the return valve so that the pressure in the common liquid chamber 85 and the individual liquid chamber 86 does not increase.

Figure 10:
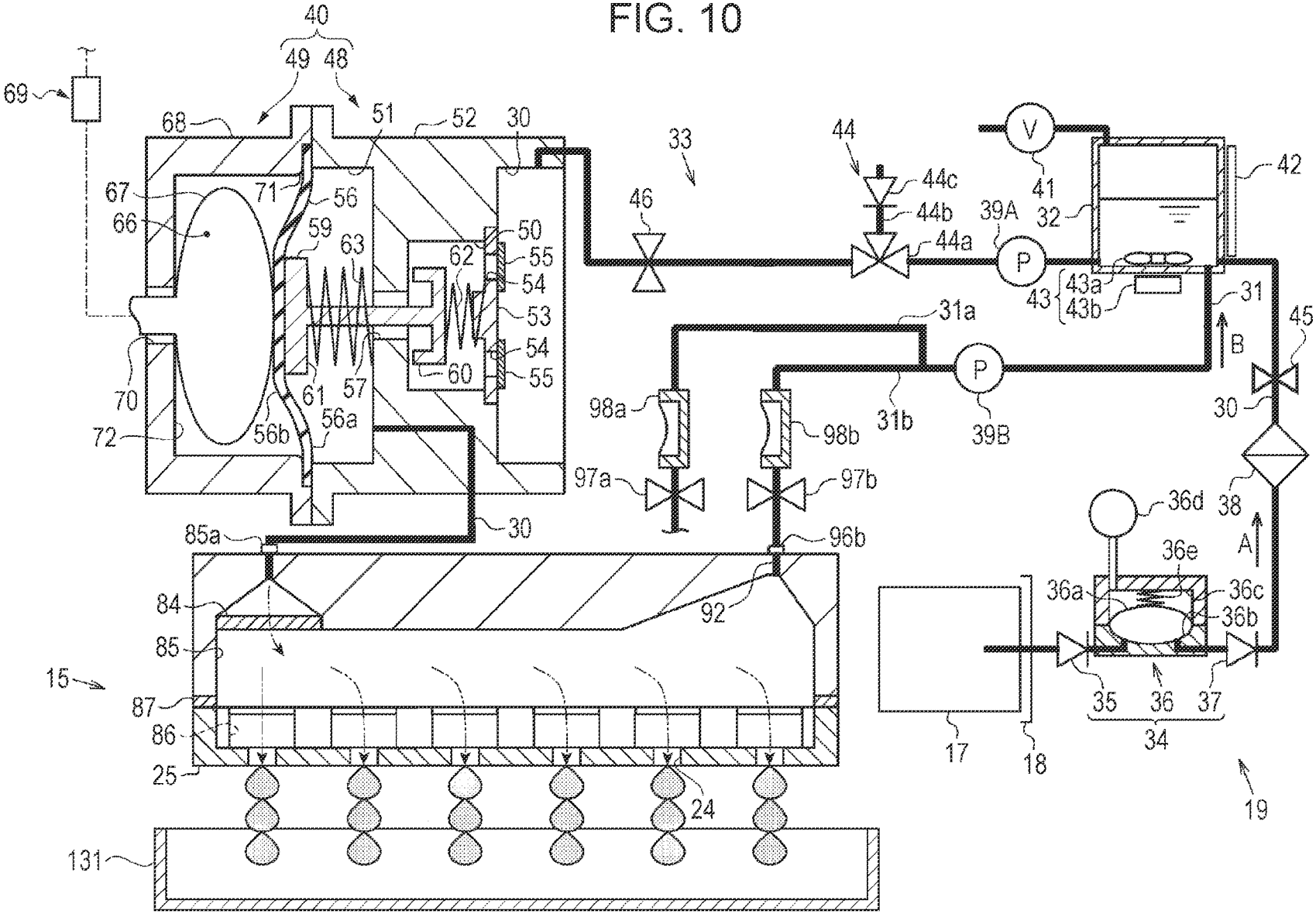
FIG. 10 is a cross-sectional view schematically illustrating a pressurization discharge operation.

The liquid ejecting apparatus 11 may perform a pressurization discharge operation of discharging the liquid from the nozzle 24 of the liquid ejecting portion 15, by setting the pressure in the liquid ejecting portion 15 including the inside of the common flow path to a pressure equal to or higher than the pressure capable of destroying the meniscus formed in the nozzle 24, for example, when the printing operation is not performed. As illustrated in FIG. 10, in the present embodiment, the control portion 111 causes the pressing mechanism 49 of the pressure regulation device 40 to push the diaphragm 56 to open the supply valve 59 of the pressure adjustment mechanism 48. The liquid pressurized by the supply pump 39A as the supply-side flow mechanism is supplied to the pressure adjustment mechanism 48 and the liquid ejecting portion 15, and the pressurization discharge operation of discharging the liquid from the nozzle 24 is performed by pressurizing the liquid in the liquid ejecting portion 15 including the common liquid chamber 85.

After the pressurization discharge operation is performed, the pressure in the liquid ejecting portion 15 is likely to be higher than that during the printing operation. Therefore, when the printing operation is performed after the pressurization discharge operation is performed, the liquid ejection from the nozzle 24 of the liquid ejecting portion 15 may be unstable. For example, the size of the droplets ejected from the nozzle 24 of the liquid ejecting portion 15 may not be the desired size, or the liquid may not be ejected at the timing when the liquid needs to be ejected.

Figure 11A:
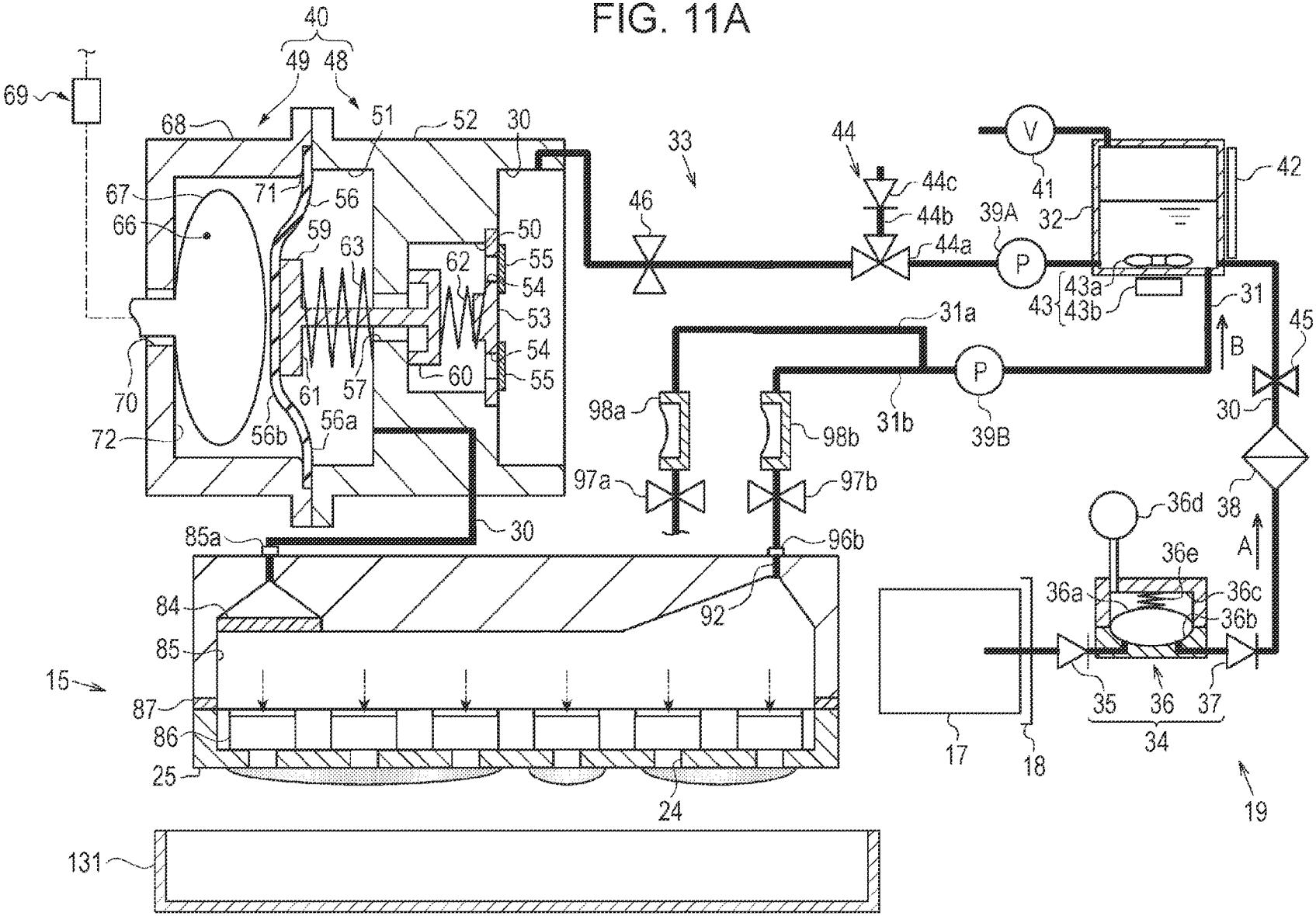
FIG. 11A is a cross-sectional view schematically illustrating a pressure lowering operation.
Figure 11B:
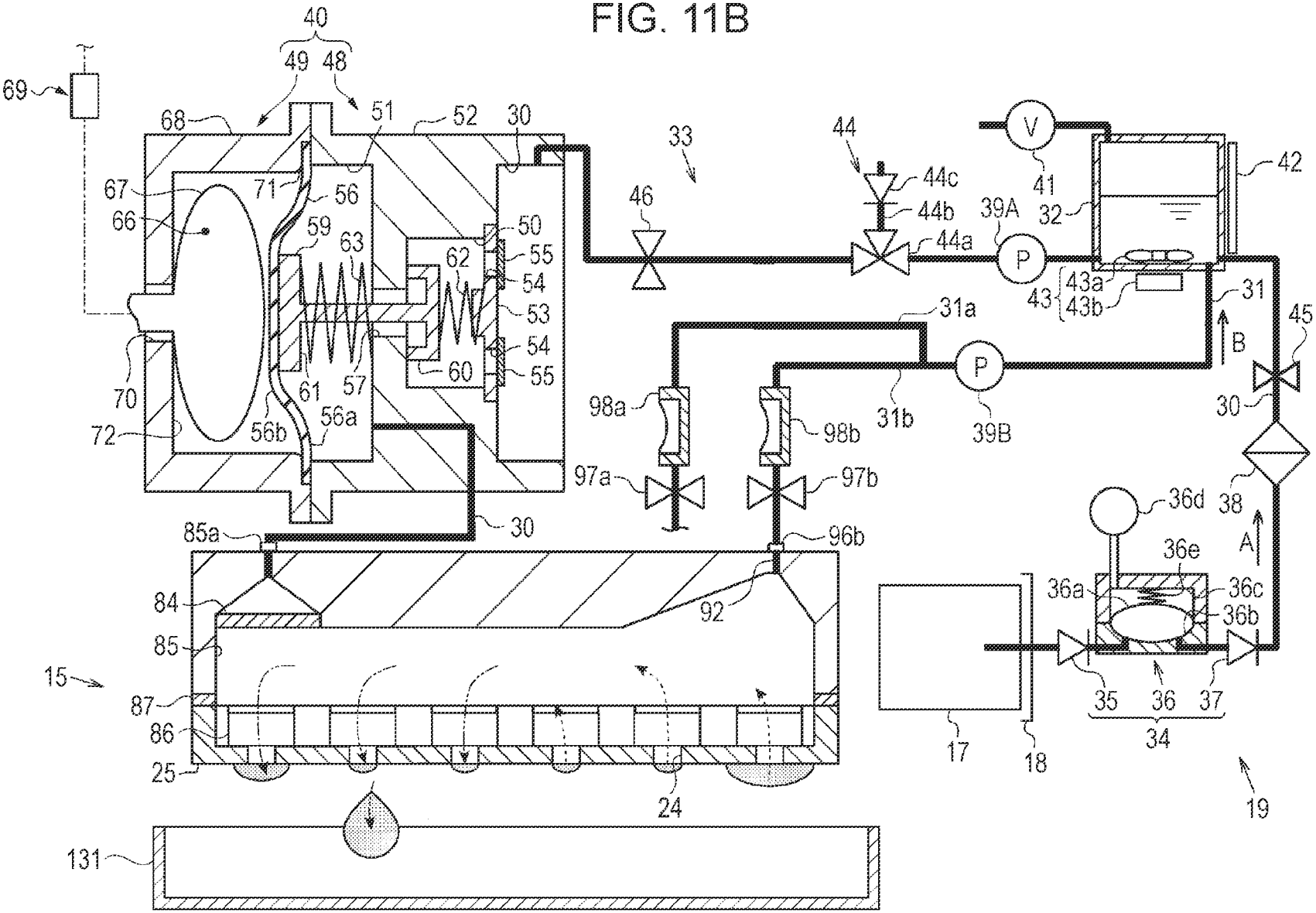
FIG. 11B is a cross-sectional view schematically illustrating a pressure lowering operation.

Therefore, in the present embodiment, when the pressurization discharge operation is performed, the control portion 111 performs a pressure lowering operation of lowering the pressure in the liquid supply flow path 30 on the downstream of the liquid ejecting portion 15 and the pressure adjustment mechanism 48, by stopping the supply of the liquid to the liquid ejecting portion 15 by the pressurization mechanism and discharging the liquid from the nozzle 24 in a state where the liquid is not supplied to the liquid ejecting portion 15 after the pressurization discharge operation, as illustrated in FIGS. 11A and 11B. The pressure lowering operation is performed until the pressure in the common liquid chamber 85 as the common flow path is lowered and the discharge of the liquid from the nozzle 24 is stopped.

When the pressure in the common liquid chamber 85 is defined as a common flow path internal pressure and the common flow path internal pressure during the printing operation of discharging the liquid from the nozzle 24 toward the medium 12 is defined as a discharge pressure, the discharge pressure is lower than the atmospheric pressure, and is maintained at −0.5 kPa to −3 kPa at a negative pressure in which a recessed meniscus is formed in the nozzle 24, for example, a gauge pressure. On the other hand, the common flow path internal pressure after performing the pressure lowering operation is higher than the atmospheric pressure, and is a positive pressure at which a projected meniscus is formed in the nozzle 24, for example, a gauge pressure of +0.1 kPa to +1 kPa. In addition, since the common flow path internal pressure in the pressurization discharge operation needs to be equal to or higher than the pressure capable of destroying the meniscus formed in the nozzle 24, for example, the gauge pressure is +5 kPa to +50 kPa. Therefore, the common flow path internal pressure in the pressurization discharge operation is higher than the discharge pressure, and the common flow path internal pressure after the pressure lowering operation is lower than the common flow path internal pressure in the pressurization discharge operation and higher than the discharge pressure.

In addition, as illustrated in FIG. 11A, after the pressurization discharge operation is performed, the liquid discharged from the nozzle 24 in the pressurization discharge operation may stay in a state of being attached to the nozzle surface 25 so as to cover the opening of the nozzle 24. When the pressure lowering operation is performed with the liquid adhering to the nozzle surface 25 so as to cover the opening of the nozzle 24, as illustrated by the two-dot chain line arrow in FIG. 11B, the flow of the liquid into the common liquid chamber 85 as a common flow path may be generated due to the discharge of the liquid from the nozzle 24 or the dropping of the liquid adhering to the nozzle surface 25 so as to cover the opening of the nozzle 24. Due to the flow of the liquid, as illustrated by the broken line arrow in FIG. 11B, the liquid adhering to the nozzle surface 25 so as to cover the openings of the other nozzle 24 communicating with the nozzle 24 via the common flow path may flow into the nozzle 24 in the liquid ejecting portion 15, or the individual liquid chamber 86, and further into the common flow path.

In addition, since the pressure lowering operation is performed in a state where the pressurization in the pressurization discharge operation remains in the liquid ejecting portion 15, when the pressure lowering operation is performed while allowing the flow of the liquid in the liquid return flow path 31, in the pressure lowering operation, the liquid containing foreign matter or a different type of liquid adhering to the nozzle surface 25 flowed into the liquid ejecting portion 15 may flow into the liquid return flow path 31 via the common flow path and the second discharge port 96*b* as the discharge port.

Therefore, the control portion 111 performs the pressure lowering operation in a state where the flow of the liquid in the liquid return flow path 31 is blocked. In the present embodiment, the control portion 111 performs the pressure lowering operation in a state where the first return valve 97*a* and the second return valve 97*b* as the return valves provided in the liquid return flow path 31 are closed. As a result, even when the liquid containing a foreign matter or a different type of liquid adhering to the nozzle surface 25 flows into the liquid ejecting portion 15 in the pressure lowering operation, it is possible to reduce the inflow of the liquid into the liquid return flow path 31.

Figure 12:
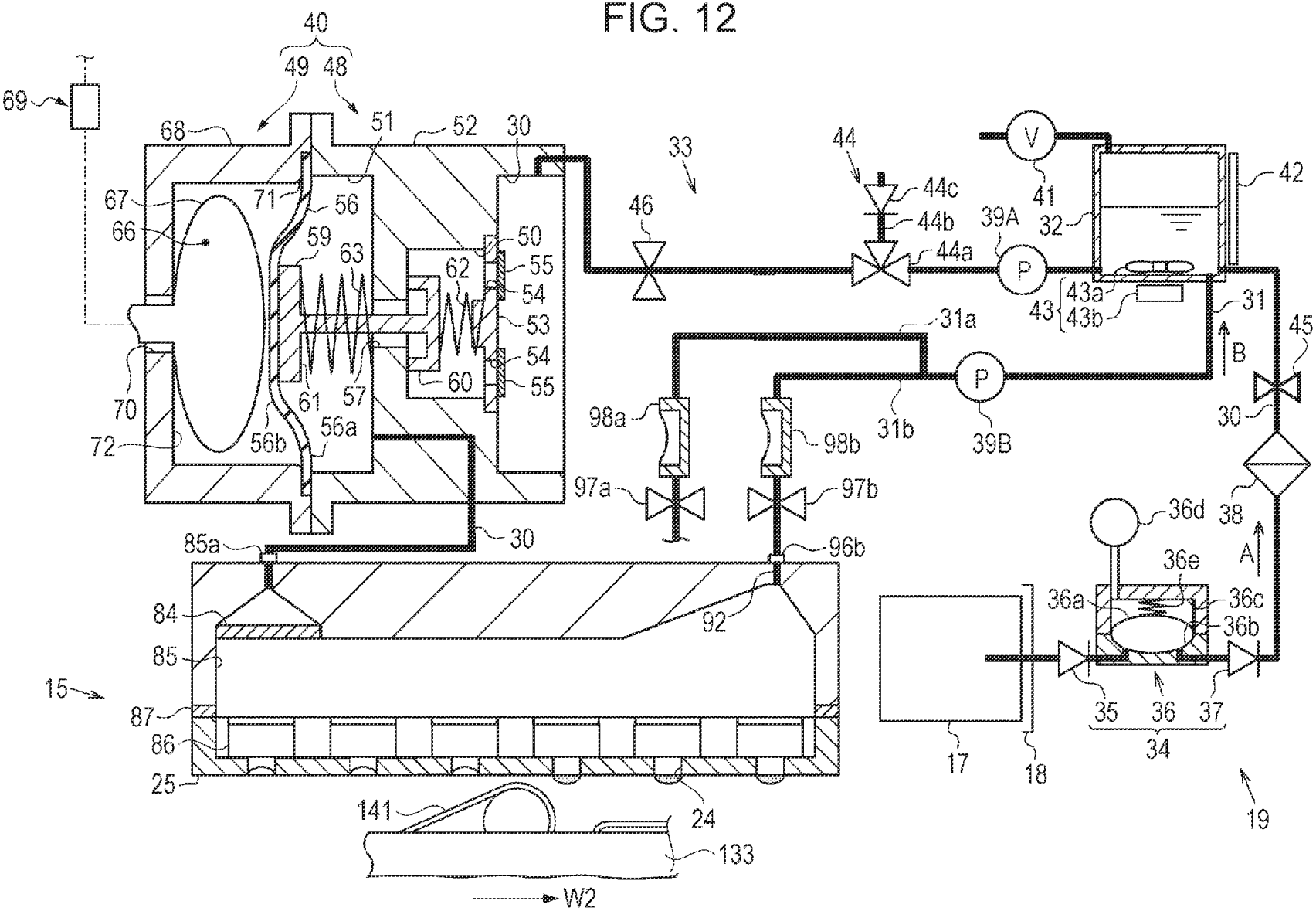
FIG. 12 is a cross-sectional view schematically illustrating a wiping operation.

In addition, the liquid ejecting apparatus 11 performs a wiping operation of wiping the nozzle surface 25 in a state where the flow of the liquid in the liquid return flow path 31 is blocked after the pressure lowering operation. As illustrated in FIG. 12, in the present embodiment, the control portion 111 drives the wiping mechanism 133 to perform the wiping operation in a state where the first return valve 97*a* and the second return valve 97*b* as the return valves are closed after the pressure lowering operation. Since the common flow path internal pressure after the pressure lowering operation is a positive pressure at which a projected meniscus is formed in the nozzle 24, when the meniscus is broken during the wiping operation, the liquid or air adhering to the nozzle surface 25 is unlikely to flow into the liquid ejecting portion 15 than in a case in which the meniscus is broken when the common flow path internal pressure is the discharge pressure. Therefore, in the wiping operation, it is possible to reduce the inflow of liquid or air adhering to the nozzle surface 25 into the liquid ejecting portion 15, and to adjust the state of the nozzle surface 25 after the pressure lowering operation. In addition, since the wiping operation is performed in a state where the flow of the liquid in the liquid return flow path 31 is blocked, even when the meniscus formed in the nozzle 24 is broken in the wiping operation, it is possible to reduce the inflow of the liquid or air adhering to the nozzle surface 25 into the liquid return flow path 31 via the nozzle 24.

Figure 13:
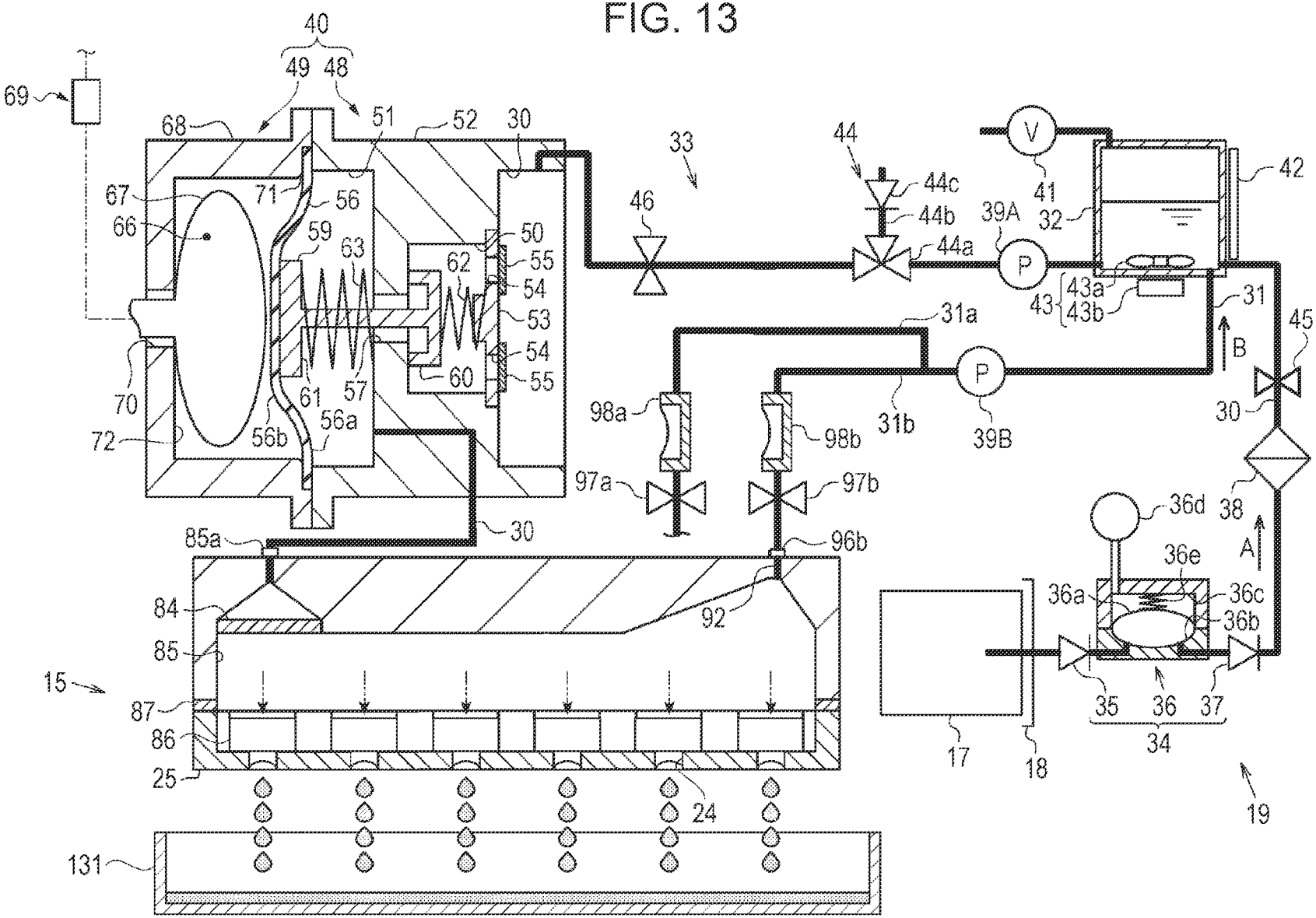
FIG. 13 is a cross-sectional view schematically illustrating a flushing operation.

In addition, after the wiping operation, the liquid ejecting apparatus 11 performs a flushing operation in a state where the flow of the liquid in the liquid return flow path 31 is blocked. As illustrated in FIG. 13, in the present embodiment, the control portion 111 drives the discharge element 89 of the liquid ejecting portion 15 to perform the flushing operation of discharging the liquid from the nozzle 24 in a state where the first return valve 97*a* and the second return valve 97*b* as the return valves provided in the liquid return flow path 31 are closed. As a result, the state of the nozzle 24 after the wiping operation can be adjusted. For example, when the common flow path internal pressure after the wiping operation is higher than the discharge pressure, the common flow path internal pressure can be set to the discharge pressure by the flushing operation, and a recessed meniscus can be formed in the nozzle 24. In addition, when a liquid or air containing a foreign matter or a different type of liquid flows into the liquid ejecting portion 15, the liquid or air can be discharged from the nozzle 24. In this case, for example, the liquid equal to or larger than the amount of the liquid in the liquid ejecting portion 15 may be discharged from the nozzle 24 by the flushing operation.

Next, with reference to the flowchart illustrated in FIG. 14, a flow of treatment performed when the control portion 111 of the liquid ejecting apparatus 11 performs the maintenance operation including the pressurization discharge operation in the present embodiment will be described. In the present embodiment, the flow of treatment performed when the control portion 111 performs the maintenance operation including the pressurization discharge operation corresponds to a maintenance method of the liquid ejecting apparatus 11. This series of treatments performed by the control portion 111 may be performed for each control cycle set in advance, may be performed based on the detection result of the ejection state detection portion 113, or may be manually performed by the user (operator) of the liquid ejecting apparatus 11.

Figure 14:
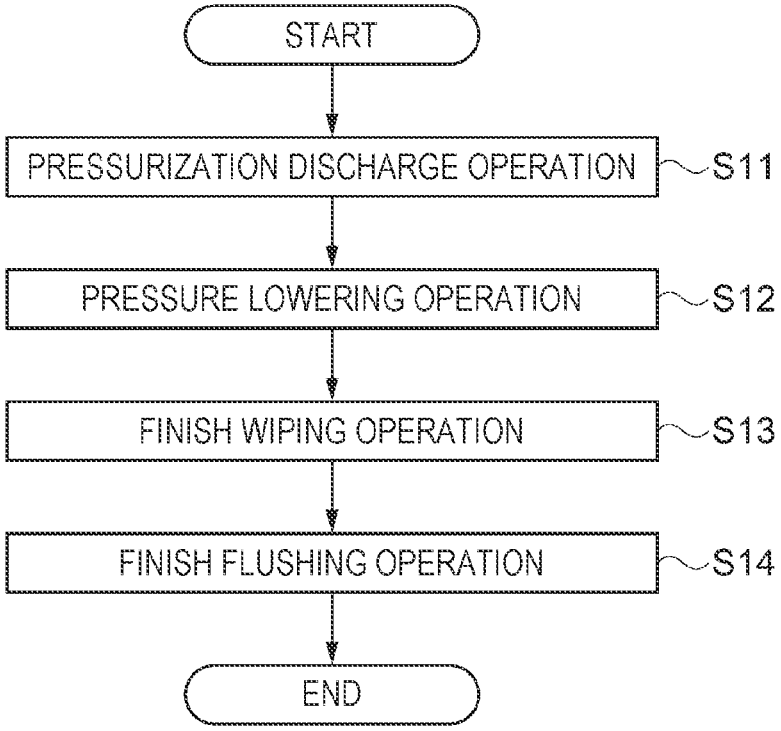
FIG. 14 is a flowchart illustrating an example of a cleaning treatment including the pressurization discharge operation.

As illustrated in FIG. 14, the control portion 111 causes the first return valve 97*a* and the second return valve 97*b* to be in the valve-closed state and performs a pressurization discharge operation (Step S11). Specifically, the control portion 111 controls the drive of the pressing mechanism 49 and displaces the diaphragm 56 in the direction where the volume of the liquid outflow portion 51 decreases to be the supply valve 59 in the valve-opened state. In this manner, the pressurized liquid flows into the liquid outflow portion 51, the liquid supply flow path 30, the common liquid chamber 85, the individual liquid chamber 86, and the nozzle 24, so that the liquid is discharged from the nozzle 24. In the pressurization discharge operation, as illustrated in FIG. 10, the liquid is continuously discharged from each nozzle 24.

Subsequently, the control portion 111 performs a pressure lowering operation by stopping the pressurization in the liquid ejecting portion 15 including the common flow path by the pressurization mechanism (Step S12). Specifically, the control portion 111 controls the drive of the pressing mechanism 49 and displaces the diaphragm 56 in the direction where the volume of the liquid outflow portion 51 increases to cause the supply valve 59 to be in the valve-closed state. As a result, although the pressurized liquid is not supplied to the downstream of the liquid outflow portion 51 of the pressure adjustment mechanism 48, since the positive pressure in the pressurization discharge operation remains in the liquid outflow portion 51, the liquid ejecting portion 15, and the liquid supply flow path 30 between the liquid outflow portion 51 and the liquid ejecting portion, the liquid continues to flow out from the nozzle 24. In the pressure lowering operation, the amount of liquid flowing out from the nozzle 24 per unit time is smaller than that in the pressurization discharge operation. The pressure lowering operation is performed until the outflow of the liquid from the nozzle 24 is stopped.

When a predetermined time is elapsed from the start of the pressure lowering operation, the control portion 111 determines that the outflow of the liquid from the nozzle 24 is stopped. For example, the predetermined time is set based on the standby time required from the start of the pressure lowering operation to the stop of the outflow of the liquid from the nozzle 24 obtained from the experimental results in advance. The standby time increases as the viscosity of the liquid increases. Therefore, the control portion 111 may change the standby time by estimating the viscosity of the liquid from the vibration waveform of the individual liquid chamber 86 detected by the ejection state detection portion 113.

Alternatively, the control portion 111 may estimate whether or not the outflow of the liquid from the nozzle 24 is stopped based on the vibration waveform of the individual liquid chamber 86 detected by the ejection state detection portion 113. For example, when it is estimated from the vibration waveform of the individual liquid chamber 86 that the position of the liquid in the nozzle 24 is the same as the position of the projected meniscus, the control portion 111 may determine that the outflow of the liquid from the nozzle 24 is stopped. In addition, for example, when the change in the vibration waveform of the individual liquid chamber 86 stops due to the decrease in the amount of liquid adhering to the nozzle surface 25 and communicating with the liquid in the nozzle 24, the control portion 111 may determine that the outflow of the liquid from the nozzle 24 is stopped.

In addition, for example, when the pressure fluctuation in the individual liquid chamber 86 due to the discharge of the liquid from the nozzle 24 or the dropping of the liquid adhering to the nozzle surface 25 so as to cover the opening of the nozzle 24 is no longer detected by the ejection state detection portion 113, the control portion 111 may determine that the outflow of the liquid from the nozzle 24 is stopped. In addition, for example, when a state where the vibration waveform of the individual liquid chamber 86 communicating with the other nozzle 24 adjacent to the individual liquid chamber 86 communicating with one nozzle 24 is detected is changed to a state where the vibration waveform is not detected, the control portion 111 may estimate that a state where the openings of one nozzle 24 and the other nozzle 24 are covered with the liquid adhering to the nozzle surface 25 is eliminated, and may determine that the outflow of the liquid from the nozzle 24 is stopped.

After the outflow of the liquid from the nozzle 24 is stopped, the control portion 111 drives the wiping mechanism 133 to perform a wiping operation of wiping the nozzle surface 25 (Step S13). In the following description, the wiping operation is also referred to as a finish wiping operation. The finish wiping operation is performed in the state where the first return valve 97*a* and the second return valve 97*b* are in the valve-closed state. By this finish wiping operation, the liquid and foreign matter adhering to the nozzle surface 25 are removed.

The control portion 111 drives the discharge element 89 of the liquid ejecting portion 15 to perform a flushing operation of discharging the liquid from the nozzle 24 (Step S14). In the following description, the flushing operation is also referred to as a finish flushing operation. The finish flushing operation is performed in the state where the first return valve 97*a* and the second return valve 97*b* are in the valve-closed state. By the finish flushing operation, the state of the nozzle 24 after the wiping operation can be adjusted. For example, when the common flow path internal pressure after the wiping operation is higher than the discharge pressure, the common flow path internal pressure can be set to the discharge pressure by the flushing operation. In addition, even when a foreign matter containing a different liquid or air flows into the liquid ejecting portion 15 by the pressure lowering operation, the foreign matter can be discharged from the nozzle 24. The drive specifications of the discharge element 89 in the finish flushing operation may be the same as the drive specifications of the discharge element 89 in the flushing operation as the second discharge operation performed in the printing operation.

As described above, according to Embodiment 1, the following effects can be obtained.

The liquid ejecting apparatus 11 includes the liquid ejecting portion 15 that has the supply port 85*a* into through the liquid can flow in, the first discharge port 96*a* and the second discharge port 96*b* as discharge ports through which the liquid can flow out, the common liquid chamber 85 as the common flow path communicating with the supply port 85*a*, the first discharge port 96*a*, and the second discharge port 96*b*, an individual liquid chamber 86 communicating with the common liquid chamber 85, the nozzle 24 communicating with the individual liquid chamber 86, the nozzle surface 25 on which the plurality of the nozzles 24 are open, and the discharge element 89, and that can discharge the liquid in the individual liquid chamber 86 from the nozzle 24 toward the medium 12 by driving the discharge element 89, the liquid supply flow path 30 coupled to the supply port 85*a* so that the liquid can be supplied to the liquid ejecting portion 15, the liquid return flow path 31 coupled to the first discharge port 96*a* and the second discharge port 96*b* so that the liquid supplied to the liquid ejecting portion 15 can be returned to the liquid supply flow path 30, the supply pump 39A as the pressurization mechanism that can pressurize the liquid in the liquid ejecting portion 15, the return valve provided in the liquid return flow path 31 that can take the valve-closed state blocking the flow of the liquid and the valve-opened state allowing the flow of the liquid, and the control portion 111, in which the control portion 111 performs the pressurization discharge operation of discharging the liquid from the nozzle 24 by causing the pressurization mechanism to pressurize the liquid in the liquid ejecting portion 15, and the pressure lowering operation of lowering the pressure in the liquid ejecting portion 15 by causing the pressurization mechanism to stop the pressurization in the liquid ejecting portion 15 in the state where the return valve is closed.

Accordingly, even when the liquid containing a foreign matter or a different type of liquid adhering to the nozzle surface 25 flows into the liquid ejecting portion 15 from the opening of the nozzle 24 in the pressure lowering operation, since the pressure lowering operation is performed in a state where the flow of the liquid in the liquid return flow path 31 is blocked, it is possible to reduce the inflow of the liquid flowed into the liquid ejecting portion 15 into the liquid return flow path 31.

The liquid ejecting apparatus 11 includes the wiping mechanism 133 capable of performing the wiping operation of wiping the nozzle surface 25, and the control portion 111 drives the wiping mechanism 133 to perform the wiping operation in the state where the return valve is closed after the pressure lowering operation. Accordingly, the state of the nozzle surface 25 after the pressure lowering operation can be adjusted. In addition, since the wiping operation is performed in a state where the flow of the liquid in the liquid return flow path 31 is blocked, even when the meniscus formed in the nozzle 24 is broken in the wiping operation, it is possible to reduce the inflow of the liquid or air adhering to the nozzle surface 25 into the liquid return flow path 31 via the nozzle 24.

The control portion 111 of the liquid ejecting apparatus 11 drives the discharge element 89 to perform the flushing operation of discharging the liquid from the nozzle 24 in the state where the return valve is closed after the wiping operation. Accordingly, the state of the nozzle 24 after the wiping operation can be adjusted. In addition, when a liquid or air containing a foreign matter or a different type of liquid flows into the liquid ejecting portion 15, the liquid or air can be discharged from the nozzle 24.

When the pressure in the liquid in the common liquid chamber 85 as the common flow path is defined as the common flow path internal pressure and the common flow path internal pressure when discharging the liquid from the nozzle 24 toward the medium 12 is defined as the discharge pressure, the common flow path internal pressure in the pressurization discharge operation is higher than the discharge pressure, and the common flow path internal pressure after the pressure lowering operation is lower than the common flow path internal pressure in the pressurization discharge operation and higher than the discharge pressure. Accordingly, when the pressurization discharge operation, the pressure lowering operation, and the wiping operation are performed, it is possible to reduce the inflow of the liquid or air containing a foreign matter or a different type of liquid adhering to the nozzle surface 25 from the opening of the nozzle 24 into the liquid ejecting portion 15.

The liquid ejecting apparatus 11 further includes the liquid storage portion 32 that stores the liquid supplied to the liquid ejecting portion 15 and is coupled to the liquid supply flow path 30 and the liquid return flow path 31, and the supply valve 59 provided between the liquid storage portion 32 in the liquid supply flow path 30 and the liquid ejecting portion 15 and that can take a valve-closed state blocking the flow of the liquid and a valve-opened state allowing the flow of the liquid, in which the supply pump 39A as the pressurization mechanism is provided between the liquid storage portion 32 and the supply valve 59 in the liquid supply flow path 30, and the control portion 111 supplies the liquid to the liquid ejecting portion 15 by opening the supply valve 59 to perform the pressurization discharge operation, and closes the supply valve 59 to perform the pressure lowering operation. Accordingly, the pressurization discharge operation and the pressure lowering operation can be performed by opening and closing the supply valve 59.

The liquid ejecting apparatus 11 further includes the return pump 39B as the return-side flow mechanism provided between the return valve and the liquid storage portion 32 in the liquid return flow path 31 and that can discharge the liquid from the discharge port, in which the supply valve 59 opens when the pressure in the common flow path is equal to or lower than a predetermined pressure, and the control portion 111 causes the return pump 39B as the return-side flow mechanism to discharge the liquid from the discharge port. Accordingly, the supply valve 59 can be opened by causing the return-side flow mechanism to discharge the liquid from the discharge port, and the liquid supplied from the liquid supply flow path 30 to the liquid ejecting portion 15 can be returned to the liquid supply flow path 30 via the liquid return flow path 31.

The control portion 111 of the liquid ejecting apparatus 11 closes the return valve before performing the pressurization discharge operation. Accordingly, by stopping the pressurization in the common flow path in the liquid ejecting portion 15 by the pressurization mechanism, after the pressurization discharge operation, the pressure lowering operation can be performed in a state where the flow of the liquid in the liquid return flow path 31 is blocked.

The maintenance method of the liquid ejecting apparatus 11 which includes the liquid ejecting portion 15 having the supply port 85*a* through which the liquid can flow in, the first discharge port 96*a* and the second discharge port 96*b* as the discharge port through which the liquid can flow out, the common liquid chamber 85 as the common flow path communicating with the supply port 85*a*, the first discharge port 96*a*, and the second discharge port 96*b*, the individual liquid chamber 86 communicating with the common liquid chamber 85, the nozzle 24 communicating with the individual liquid chamber 86, the nozzle surface 25 on which the plurality of the nozzles 24 are open, and the discharge element 89, and capable of discharging the liquid in the individual liquid chamber 86 from the nozzle 24 toward the medium 12 by driving the discharge element 89, the liquid supply flow path 30 coupled to the supply port 85*a* so that the liquid can be supplied to the liquid ejecting portion 15, and the liquid return flow path 31 coupled to the first discharge port 96*a* and the second discharge port 96*b* so that the liquid supplied to the liquid ejecting portion 15 can be returned to the liquid supply flow path 30, the maintenance method includes performing the pressurization discharge operation of pressurizing the liquid in the liquid ejecting portion 15 and discharging the liquid from the nozzle 24, and performing the pressure lowering operation of lowering the pressure in the liquid ejecting portion 15 in the state where the flow of the liquid in the liquid return flow path 31 is blocked after the pressurization discharge operation.

Accordingly, even when the liquid containing a foreign matter or a different type of liquid adhering to the nozzle surface 25 flows into the liquid ejecting portion 15 from the opening of the nozzle 24 in the pressure lowering operation, since the pressure lowering operation is performed in a state where the flow of the liquid in the liquid return flow path 31 is blocked, it is possible to reduce the inflow of the liquid flowed into the liquid ejecting portion 15 into the liquid return flow path 31.

In the maintenance method of the liquid ejecting apparatus, the wiping operation of wiping the nozzle surface 25 is performed in the state where the flow of the liquid in the liquid return flow path 31 is blocked after the pressure lowering operation. Accordingly, the state of the nozzle surface 25 after the pressure lowering operation can be adjusted. In addition, since the wiping operation is performed in a state where the flow of the liquid in the liquid return flow path 31 is blocked, even when the meniscus formed in the nozzle 24 is broken in the wiping operation, it is possible to reduce the inflow of the liquid or air adhering to the nozzle surface 25 into the liquid return flow path 31 via the nozzle 24.

In the maintenance method of the liquid ejecting apparatus, the flushing operation of driving the discharge element 89 to discharge the liquid from the nozzle 24 is performed in the state where the flow of the liquid in the liquid return flow path 31 is blocked after the wiping operation. Accordingly, the state of the nozzle 24 after the wiping operation can be adjusted. In addition, when a liquid or air containing a foreign matter or a different type of liquid flows into the liquid ejecting portion 15, the liquid or air can be discharged from the nozzle 24.

In the maintenance method of the liquid ejecting apparatus, when the pressure of the liquid in the common liquid chamber 85 as the common flow path is defined as the common flow path internal pressure and the common flow path internal pressure when discharging the liquid from the nozzle 24 toward the medium 12 is defined as the discharge pressure, the common flow path internal pressure in the pressurization discharge operation is higher than the discharge pressure, and the common flow path internal pressure after the pressure lowering operation is lower than the common flow path internal pressure in the pressurization discharge operation and higher than the discharge pressure. Accordingly, when the pressurization discharge operation, the pressure lowering operation, and the wiping operation are performed, it is possible to reduce the inflow of the liquid or air containing a foreign matter or a different type of liquid adhering to the nozzle surface 25 from the opening of the nozzle 24 into the liquid ejecting portion 15.

2. Embodiment 2

Figure 15:
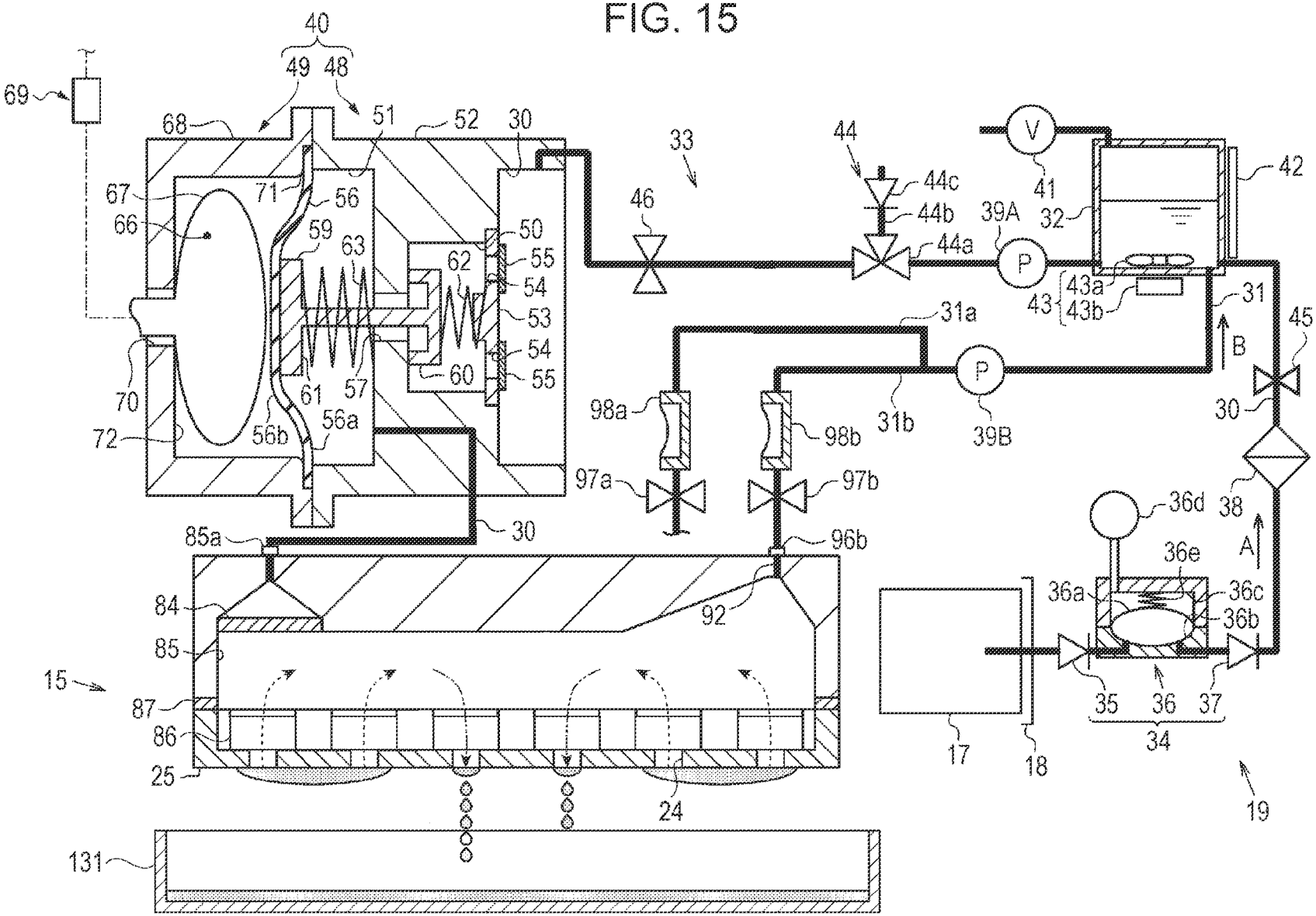
FIG. 15 is a cross-sectional view schematically illustrating a pressure lowering operation according to Embodiment 2.

FIG. 15 is a cross-sectional view schematically illustrating a pressure lowering operation according to Embodiment 2. The present embodiment is an embodiment in which the pressure lowering operation in Embodiment 1 is modified.

The liquid ejecting apparatus 11 may perform the flushing operation during the pressure lowering operation. In the present embodiment, the control portion 111 performs the pressure lowering operation including the flushing operation after the pressurization discharge operation. In the present embodiment, the flow of treatment performed when the control portion 111 performs the pressure lowering operation corresponds to the maintenance method of the liquid ejecting apparatus 11. Specifically, the control portion 111 performs the flushing operation of driving the discharge element 89 of the liquid ejecting portion 15 to discharge the liquid from the nozzle 24 in the pressure lowering operation in Embodiment 1. In the following description, the flushing operation is also referred to as a pressure lowering flushing operation.

The drive specifications of the discharge element 89 in the pressure lowering flushing operation may differ from the drive specifications of the discharge element 89 in the flushing operation performed as the second discharge operation during the printing operation, considering that the state of the meniscus formed in the nozzle 24 is different from that during the printing operation. As a result, for example, the size of the droplets discharged in the pressure lowering flushing operation may be smaller than the size of the droplets discharged in the flushing operation as the second discharge operation. In addition, for example, the discharge speed of the droplets discharged in the pressure lowering flushing operation may be faster than the discharge speed of the droplets discharged in the flushing operation as the second discharge operation. The pressure lowering operation is performed until the outflow of the liquid from the nozzle 24 is stopped.

The number of times the discharge element 89 is driven in the pressure lowering flushing operation may be set a set number of times based on the time required for the pressure lowering operation obtained in advance from experimental results and the like. Alternatively, the specification may be such that the discharge element 89 is intermittently driven in the pressure lowering flushing operation, and the control portion 111 may estimate whether or not the discharge of the liquid from the nozzle 24 is stopped and may continue to drive the discharge element 89 until the outflow of the liquid from the nozzle 24 is stopped, based on the vibration waveform of the individual liquid chamber 86 detected by the ejection state detection portion 113, when the discharge element 89 is not drive in the pressure lowering operation.

When the discharge elements 89 corresponding to all the nozzles 24 communicating with the common liquid chamber 85 as a common flow path are driven in order to perform the pressure lowering flushing operation in the pressure lowering operation, as illustrated in FIG. 15, droplets are not discharged from the nozzle 24 in which the opening is covered with the liquid adhering to the nozzle surface 25, and the droplets are sequentially discharged from the nozzle 24 in which a projected meniscus is formed in the nozzle 24 due to dropping of the liquid adhering to the nozzle surface 25 or the like. At this time, as illustrated by the two-dot chain line arrow in FIG. 15, due to the discharge of droplets from the nozzle 24, the flow of the liquid may be generated in the common liquid chamber 85 as a common flow path, and the liquid adhering to the nozzle surface 25 may flow into the liquid ejecting portion 15 so as to cover the opening of other nozzle 24 communicating with the nozzle 24 via the common flow path, as illustrated by the broken line arrow in FIG. 15.

In the present embodiment as well, as in Embodiment 1, the control portion 111 performs the pressure lowering operation in a state where the first return valve 97*a* and the second return valve 97*b* as the return valves provided in the liquid return flow path 31 are closed. As a result, the flushing operation is performed during the pressure lowering operation, and even when the liquid containing a foreign matter or a different type of liquid adhering to the nozzle surface 25 flows into the liquid ejecting portion 15 in the pressure lowering operation, it is possible to reduce the inflow of the liquid into the liquid return flow path 31.

As described above, according to Embodiment 2, the following effects can be obtained.

The control portion 111 of the liquid ejecting apparatus 11 performs the flushing operation during the pressure lowering operation. In addition, in the maintenance method of the liquid ejecting apparatus 11, the flushing operation is performed during the pressure lowering operation. Accordingly, it is possible to promote the lowering of the pressure in the liquid ejecting portion 15 in the pressure lowering operation by discharging the droplets from the nozzle 24 by the flushing operation. In addition, since the pressure lowering operation including the flushing operation is performed in the state where the flow of the liquid in the liquid return flow path 31 is blocked, even when the liquid containing a foreign matter or a different type of liquid adhering to the nozzle surface 25 flows into the liquid ejecting portion 15 in the pressure lowering operation, it is possible to reduce the inflow of the liquid into the liquid return flow path 31.

3. Embodiment 3

Figure 16:
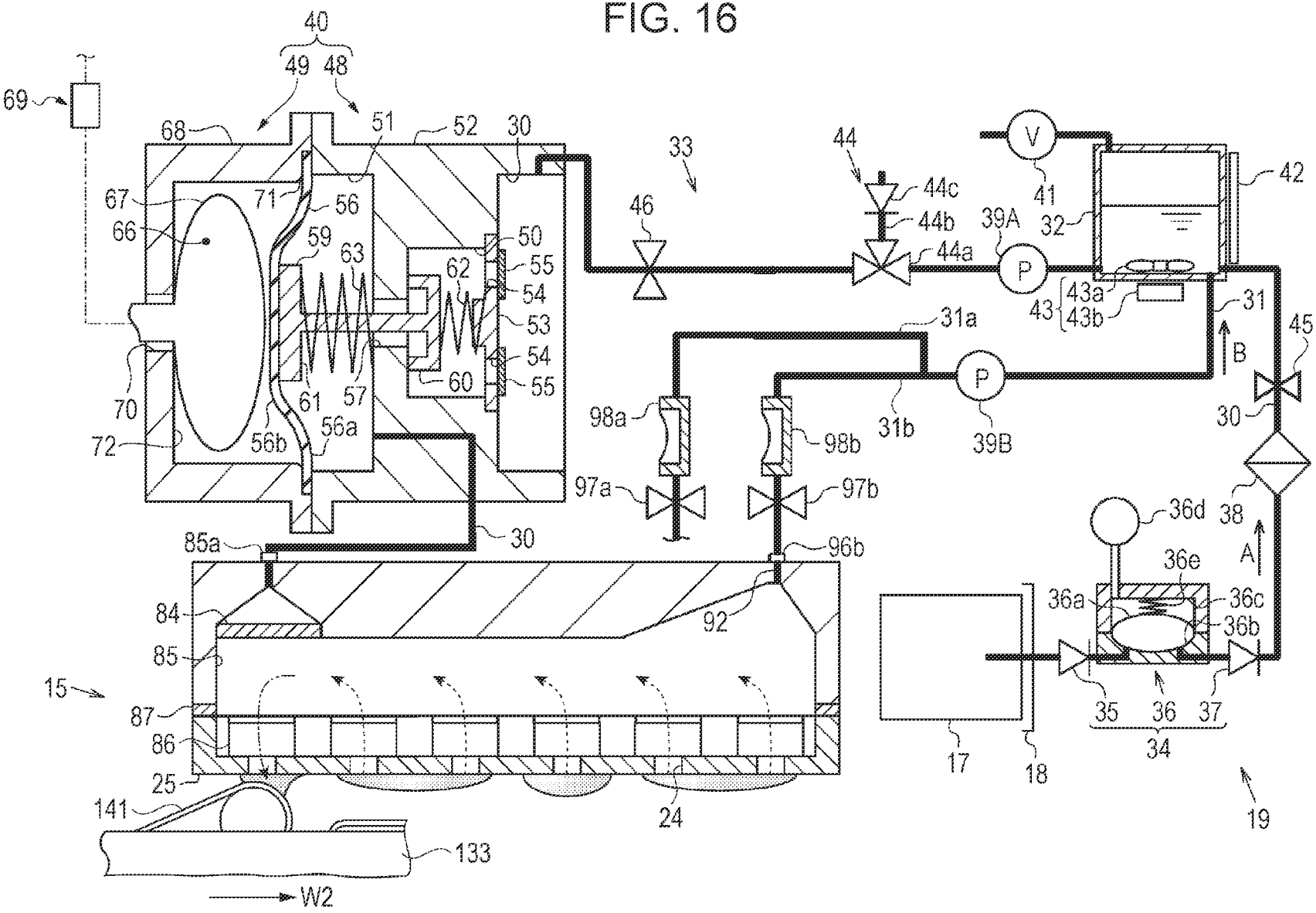
FIG. 16 is a cross-sectional view schematically illustrating a pressure lowering operation according to Embodiment 3.

FIG. 16 is a cross-sectional view schematically illustrating the pressure lowering operation according to Embodiment 3. The present embodiment is an embodiment in which the pressure lowering operation in Embodiment 1 is modified.

The liquid ejecting apparatus 11 may perform the wiping operation during the pressure lowering operation. In the present embodiment, the control portion 111 performs the pressure lowering operation including the wiping operation after the pressurization discharge operation. Specifically, the control portion 111 drives the wiping mechanism 133 to perform the wiping operation in the pressure lowering operation in Embodiment 1. In the following description, the wiping operation is also referred to as a pressure lowering wiping operation. In the pressure lowering wiping operation, the pressing force by the pressing portion 157 for bringing the strip-shaped member 141 into contact with the nozzle surface 25 may be smaller than the pressing force in the finish wiping operation. Alternatively, in the pressure lowering wiping operation, the strip-shaped member 141 may be wiped by contacting the liquid adhering to the nozzle surface 25 without contacting the nozzle surface 25. The pressure lowering operation is performed until the outflow of the liquid from the nozzle 24 is stopped.

In this case, the control portion 111 may determine that the outflow of the liquid from the nozzle 24 is stopped due to the end of the pressure lowering wiping operation, or may estimate whether or not the outflow of the liquid from the nozzle 24 is stopped based on the vibration waveform of the individual liquid chamber 86 detected by the ejection state detection portion 113, after the pressure lowering wiping operation is completed.

When the pressure lowering wiping operation is performed in the pressure lowering operation, as illustrated in FIG. 16, the strip-shaped member 141 as the wiping portion 161 of the wiping mechanism 133 comes into contact with the liquid adhering to the nozzle surface 25 and the liquid adhering to the nozzle surface 25 is collected by the strip-shaped member 141. At this time, as illustrated by the two-dot chain line arrow in FIG. 16, the liquid adhering to the nozzle surface 25 is collected by the strip-shaped member 141 so as to cover the opening of the nozzle 24, so that the flow of the liquid is generated in the common liquid chamber 85 as a common flow path. As illustrated by the broken line arrow in FIG. 16, the liquid adhering to the nozzle surface 25 may flow into the liquid ejecting portion 15 so as to cover the opening of other nozzle 24 communicating with the nozzle 24 via the common flow path.

In the present embodiment as well, as in Embodiment 1, the control portion 111 performs the pressure lowering operation in a state where the first return valve 97*a* and the second return valve 97*b* as the return valves provided in the liquid return flow path 31 are closed. As a result, the wiping operation is performed during the pressure lowering operation, and even when the liquid containing a foreign matter or a different type of liquid adhering to the nozzle surface 25 flows into the liquid ejecting portion 15 in the pressure lowering operation, it is possible to reduce the inflow of the liquid into the liquid return flow path 31. In addition, the control portion 111 of the liquid ejecting apparatus 11 performs the wiping operation during the pressure lowering operation. Accordingly, it is possible to promote the lowering of the pressure in the liquid ejecting portion 15 in the pressure lowering operation.

4. Embodiment 4

Figure 17:
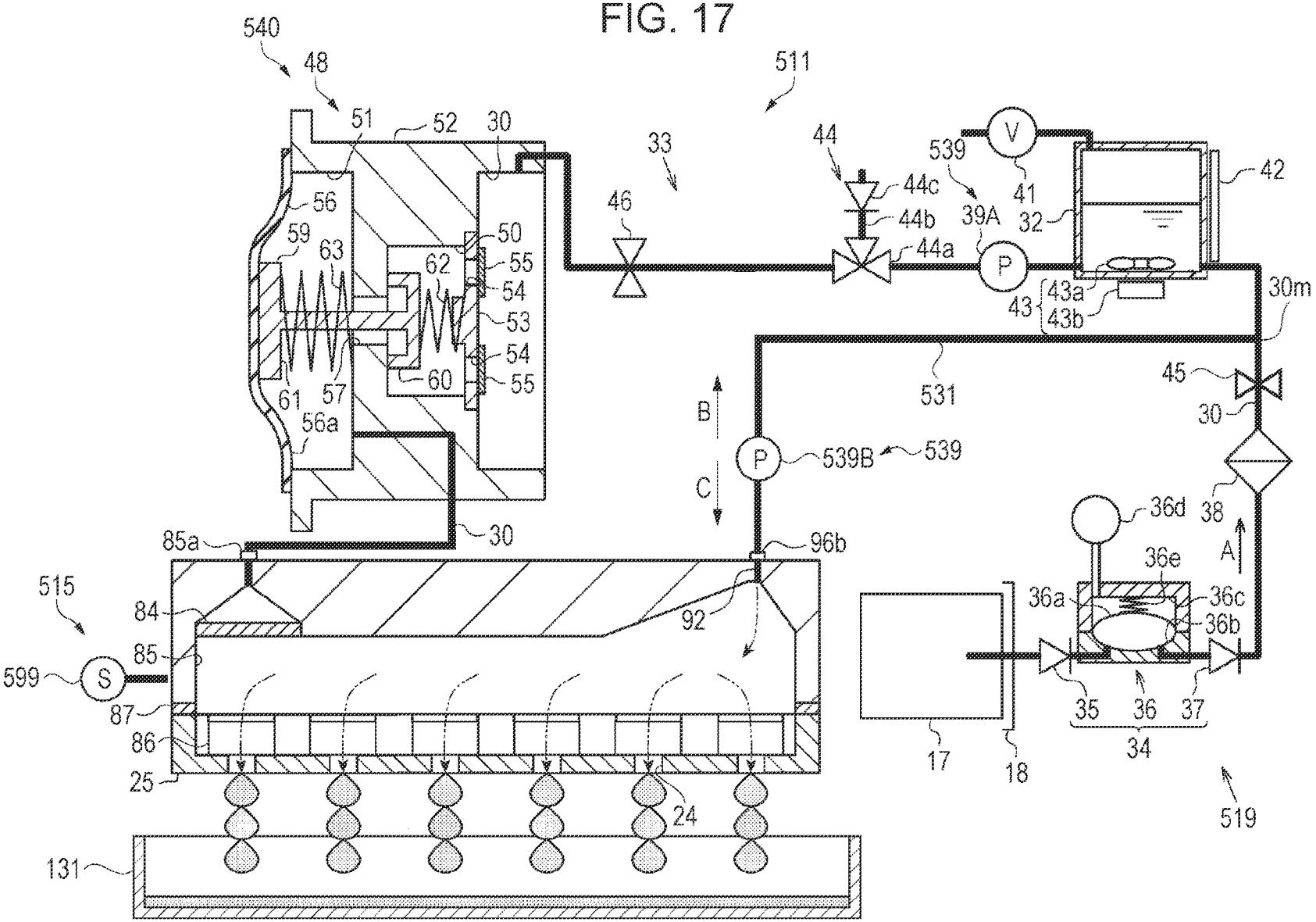
FIG. 17 is a cross-sectional view schematically illustrating a liquid ejecting portion, a liquid supply portion, and a pressurization discharge operation according to Embodiment 4.

FIG. 17 is a cross-sectional view schematically illustrating the liquid supply portion, the liquid ejecting portion, and the pressurization discharge operation in the liquid ejecting apparatus according to Embodiment 4. The liquid ejecting apparatus 511 of the present embodiment is obtained by changing the liquid ejecting portion 15 and the liquid supply portion 19 in Embodiment 1 to a liquid ejecting portion 515 and a liquid supply portion 519 illustrated in FIG. 17. For the same constituent parts as in Embodiment 1, the same numbers will be used, and duplicate description will be omitted.

As illustrated in FIG. 17, the liquid ejecting portion 515 is provided with a pressure sensor 599. The pressure sensor 599 detects the common flow path internal pressure, which is the pressure inside the common liquid chamber 85. The liquid ejecting portion 515 of the present embodiment are not provided with the first discharge port 96*a* of the liquid ejecting portion 15 of Embodiment 1. Therefore, the liquid ejecting portion 515 may not include the first discharge flow path 91 and the discharge liquid chamber 93 included in the liquid ejecting portion 15.

As illustrated in FIG. 17, the liquid supply portion 519 is provided with a pressure regulation device 540, a liquid return flow path 531, and a flow mechanism 539. The liquid supply portion 519 of the present embodiment is obtained by changing the pressure regulation device 40, the liquid return flow path 31, and the flow mechanism 39 in Embodiment 1 to the pressure regulation device 540, the liquid return flow path 531, and the flow mechanism 539.

The pressure regulation device 540 regulates the pressure in the liquid supplied to the liquid ejecting portion 515. The pressure regulation device 540 of the present embodiment is the pressure regulation device 40 of Embodiment 1 excluding the pressing mechanism 49.

The liquid return flow path 531 can form the circulation route 33 together with the liquid supply flow path 30. The liquid return flow path 531 couples the second discharge port 96*b* as a discharge port and a coupling portion 30*m* between the liquid storage portion 32 and the on-off valve 45 in the liquid supply flow path 30, so that the liquid supplied to the liquid ejecting portion 515 can be returned to the liquid supply flow path 30. The liquid return flow path 531 of the present embodiment is not provided with the return valve included in the liquid return flow path 31 of Embodiment 1.

The flow mechanism 539 can flow the liquid in the circulation route 33. The flow mechanism 539 includes a return pump 539B as a return-side flow mechanism provided in the liquid return flow path 531. The return pump 539B is provided at a position closer to the second discharge port 96*b* than the coupling portion 30*m* in the liquid return flow path 531. The flow mechanism 539 of the present embodiment is obtained by changing the return pump 39B as the return-side flow mechanism in Embodiment 1 to the return pump 539B.

The return pump 539B can flow the liquid in the liquid return flow path 531 in the return direction B from the liquid ejecting portion 515 toward the liquid supply flow path 30 and the pressurization direction C toward the liquid ejecting portion 515. The return pump 539B can be applied as a pressurization mechanism capable of pressurizing the liquid in the liquid ejecting portion 515 including the common flow path by flowing the liquid in the pressurizing direction C. The return pump 539B blocks the flow of the liquid in the liquid return flow path 531 when not driven. The return pump 539B may be, for example, a tube pump.

The liquid ejecting apparatus 511 performs a pressurization discharge operation of discharging the liquid from the nozzle 24 of the liquid ejecting portion 515 by setting the pressure in the liquid ejecting portion 515 including the common flow path to, for example, a pressure equal to or higher than the pressure capable of destroying the meniscus formed in the nozzle 24. As illustrated in FIG. 17, in the present embodiment, the control portion 111 drives the return pump 539B as a pressurization mechanism to flow the liquid in the pressurizing direction C, and pressurizes the liquid in the liquid ejecting portion 515 including the common liquid chamber 85 to perform the pressurization discharge operation of discharging the liquid from the nozzle 24. In this case, the control portion 111 performs the pressurization discharge operation by driving and controlling the return pump 539B as the pressurization mechanism.

Subsequently, the liquid ejecting apparatus 511 stops the pressurization discharge operation and performs the pressure lowering operation. Specifically, the control portion 111 stops the drive of the return pump 539B. The return pump 539B blocks the flow of the liquid in the liquid return flow path 531 when not driven. Therefore, after the pressurization discharge operation, the pressure lowering operation is performed in a state where the flow of the liquid in the liquid return flow path is blocked. In this case, the control portion 111 performs the pressure lowering operation by stopping the drive of the return pump 539B as a pressurization mechanism. The pressure lowering operation is performed until the discharge of the liquid from the nozzle 24 is stopped.

The control portion 111 determines that the discharge of the liquid from the nozzle 24 is stopped when the common flow path internal pressure detected by the pressure sensor 599 is a pressure at which a projected meniscus is formed in the nozzle 24.

As described above, according to Embodiment 4, the control portion 111 of the liquid ejecting apparatus 511 can perform the pressurization discharge operation by pressurizing the liquid in the liquid ejecting portion 515 with the return pump 539B as a pressurization mechanism, and can perform the pressure lowering operation in a state where the flow of the liquid in the liquid return flow path 531 is blocked by stopping the drive of the return pump 539B as a pressurization mechanism.

In addition, also in Embodiment 4, as in Embodiment 1, since the pressure lowering operation is performed in a state where the flow of the liquid in the liquid return flow path 531 is blocked, even when the liquid containing a foreign matter or a different type of liquid adhering to the nozzle surface 25 flows into the liquid ejecting portion 515 from the opening of the nozzle 24 in the pressure lowering operation, it is possible to reduce the inflow of the liquid flowed into the liquid ejecting portion 515 into the liquid return flow path 531.

5. Embodiment 5

Figure 18:
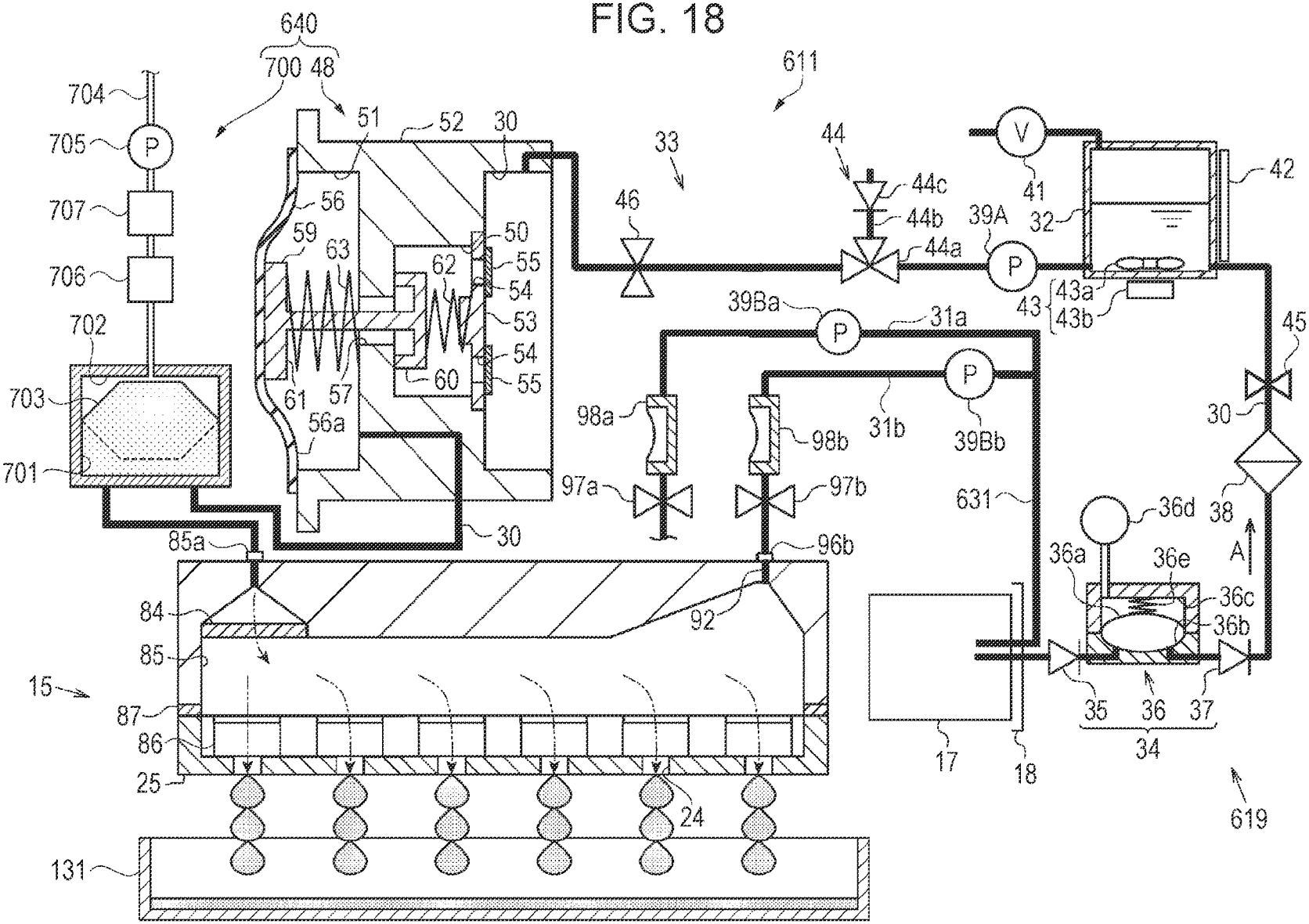
FIG. 18 is a cross-sectional view schematically illustrating a liquid ejecting portion, a liquid supply portion, and a pressurization discharge operation according to Embodiment 5.

FIG. 18 is a cross-sectional view schematically illustrating the liquid supply portion, the liquid ejecting portion, and the pressurization discharge operation in the liquid ejecting apparatus according to Embodiment 5. A liquid ejecting apparatus 611 of the present embodiment is obtained by changing the liquid supply portion 19 in Embodiment 1 to the liquid supply portion 619 illustrated in FIG. 18. For the same constituent parts as in Embodiment 1, the same numbers will be used, and duplicate description will be omitted.

As illustrated in FIG. 18, the liquid supply portion 619 is provided with a liquid return flow path 631 and a pressure regulation device 640. The liquid supply portion 619 of the present embodiment is obtained by changing the liquid return flow path 31 and the pressure regulation device 40 in Embodiment 1 to the liquid return flow path 631 and the pressure regulation device 640.

The liquid return flow path 631 can form the circulation route 33 together with the liquid supply flow path 30. The liquid return flow path 631 couples the first discharge port 96*a*, the second discharge port 96*b* (not illustrated) as discharge ports, and the liquid supply source 17 so that the liquid supplied to the liquid ejecting portion 15 can be returned to the liquid supply flow path 30. In the present embodiment, the liquid supply source 17 is coupled to the liquid supply flow path 30 and the liquid return flow path 631 to form the circulation route 33.

The first return flow path 31*a* may be provided with a first return valve 97*a* as a return valve, a first return pump 39Ba as a return pump 39B, and a first damper 98*a*. The second return flow path 31*b* may be provided with a second return valve 97*b* as a return valve, a second return pump 39Bb as a return pump 39B, and a second damper 98*b*.

The pressure regulation device 640 is provided with a pressure adjustment mechanism 700 capable of pressurizing the liquid in the liquid ejecting portion 15 including the inside of the common liquid chamber 85 as a common flow path. The pressure regulation device 640 of the present embodiment is obtained by changing the pressing mechanism 49 in Embodiment 1 to the pressure adjustment mechanism 700.

The pressure adjustment mechanism 700 is provided with a liquid storage chamber 701, an air chamber 702, a partition wall 703, an air flow path 704, an air pump 705, a pressure detector 706, and a regulator 707.

The liquid storage chamber 701 is configured to store the liquid. The liquid storage chamber 701 is provided at a position in the liquid supply flow path 30 between the liquid outflow portion 51 of the pressure regulation device 640 and the supply port 85*a* of the liquid ejecting portion 15.

The air chamber 702 is provided so as to be adjacent to the liquid storage chamber 701.

The partition wall 703 has flexibility. The partition wall 703 partitions the liquid storage chamber 701 and the air chamber 702. Therefore, for example, when the pressure in the air chamber 702 is higher than the pressure in the liquid storage chamber 701, the partition wall 703 is deformed, the volume of the air chamber 702 increases, and the volume of the liquid storage chamber 701 decreases.

The air flow path 704 is provided so as to communicate with the air chamber 702.

The air pump 705 is configured to supply air to the air chamber 702 and suck air from the air chamber 702. The air pump 705 is provided in the air flow path 704. By driving the air pump 705, when air is supplied to the air chamber 702, the pressure in the air chamber 702 and the liquid storage chamber 701 increases, and when air is sucked from the air chamber 702, the pressure in the air chamber 702 and the liquid storage chamber 701 decreases.

The pressure detector 706 is configured to detect the pressure in the air chamber 702. The pressure detector 706 is provided at a position in the air flow path 704 between the air chamber 702 and the air pump 705. The air chamber 702 is partitioned from the liquid storage chamber 701 by a flexible partition wall 703. The liquid storage chamber 701 communicates with the common liquid chamber 85 as a common flow path of the liquid ejecting portion 15 via the liquid supply flow path 30. As a result, the pressure detector 706 can detect the common flow path internal pressure via the liquid storage chamber 701 and the liquid supply flow path 30.

The regulator 707 is configured to regulate the pressure in the air chamber 702. The regulator 707 may be provided at a position in the air flow path 704 between the air pump 705 and the pressure detector 706. The regulator 707 may include, for example, a relief valve. In this case, the regulator 707 automatically opens the relief valve when the pressure in the air chamber 702 is higher than the set pressure, and the air in the air chamber 702 is discharged to the outside. In this manner, the regulator 707 regulates by reducing the pressure in the air chamber 702.

The air chamber 702 is partitioned from the liquid storage chamber 701 by a flexible partition wall 703. The liquid storage chamber 701 communicates with the common liquid chamber 85 as a common flow path of the liquid ejecting portion 15 via the liquid supply flow path 30. As a result, the pressure adjustment mechanism 700 can pressurize the liquid in the liquid ejecting portion 15 including the common liquid chamber 85 by driving the air pump 705. In addition, the pressure adjustment mechanism 700 can regulate the common flow path internal pressure in the liquid ejecting portion 15 to a predetermined pressure by driving the air pump 705 based on the pressure detected by the pressure detector 706. In addition, for example, when the volume of the liquid storage chamber 701 is increased from the state of the two-dot chain line illustrated in FIG. 18 to the state illustrated by the solid line, by driving the air pump 705 based on the pressure detected by the pressure detector 706, the pressure adjustment mechanism 700 regulates the pressure in the air chamber 702 to a negative pressure within a range in which the supply valve 59 of the pressure adjustment mechanism 48 is opened and the meniscus formed in the nozzle 24 is not broken.

The liquid ejecting apparatus 611 performs a pressurization discharge operation of discharging the liquid from the nozzle 24 of the liquid ejecting portion 15 by setting the pressure in the liquid ejecting portion 15 including the common flow path to, for example, a pressure equal to or higher than the pressure capable of destroying the meniscus formed in the nozzle 24. As illustrated in FIG. 18, in the present embodiment, the control portion 111 causes the first return valve 97*a* and the second return valve 97*b* to be in the valve-closed state, and pressurizes the liquid in the liquid storage chamber 701 via the air chamber 702 by driving the air pump 705 of the pressure adjustment mechanism 700 to supply air to the air chamber 702. By supplying the liquid in the liquid storage chamber 701 to the liquid ejecting portion 15 and pressurizing the liquid in the common liquid chamber 85, the pressurization discharge operation of discharging the liquid from the nozzle 24 is performed. In this case, the control portion 111 performs the pressurization discharge operation by driving and controlling the pressure adjustment mechanism 700 as the pressurization mechanism.

Subsequently, the liquid ejecting apparatus 611 stops the pressurization discharge operation and performs the pressure lowering operation. Specifically, the control portion 111 stops the drive of the air pump 705. In this case, the control portion 111 performs the pressure lowering operation by driving and controlling the pressure adjustment mechanism 700. The pressure lowering operation is performed until the discharge of the liquid from the nozzle 24 is stopped.

The control portion 111 may determine that the discharge of the liquid from the nozzle 24 is stopped when the common flow path internal pressure detected by the pressure detector 706 of the pressure adjustment mechanism 700 is a pressure at which a projected meniscus is formed in the nozzle 24.

In addition, the liquid ejecting apparatus 611 may drive the pressure adjustment mechanism 700 to perform the pressure lowering operation after the pressurization discharge operation. Specifically, the control portion 111 may reduce the common flow path internal pressure to a pressure at which a projected meniscus is formed by driving and controlling the air pump 705 to suck air from the air chamber 702 based on the pressure detected by the pressure detector 706.

As described above, according to Embodiment 5, the control portion 111 of the liquid ejecting apparatus 611 can perform the pressurization discharge operation by driving and controlling the pressure adjustment mechanism 700 as the pressurization mechanism, and can perform the pressure lowering operation by driving and controlling the pressure adjustment mechanism 700.

In addition, also in Embodiment 5, as in Embodiment 1, since the pressure lowering operation is performed in a state where the flow of the liquid in the liquid return flow path 631 is blocked, even when the liquid containing a foreign matter or a different type of liquid adhering to the nozzle surface 25 flows into the liquid ejecting portion 15 from the opening of the nozzle 24 in the pressure lowering operation, it is possible to reduce the inflow of the liquid flowed into the liquid ejecting portion 15 into the liquid return flow path 631.

The above embodiment and the other embodiments described below can be implemented in combination with each other to the extent that these embodiments are technically consistent. Hereinafter, other embodiments will be described.

When the pressure in the liquid ejecting portion including the common flow path can be pressurized to a pressure equal to or higher than the pressure capable of destroying the recessed meniscus in the nozzle by driving the pressurization mechanism, the liquid ejecting apparatus may perform the pressurization discharge operation in a state where the flow of the liquid in the liquid return flow path is allowed. For example, in Embodiment 1, the control portion 111 opens the supply valve 59 in a state where either the first return valve 97*a* or the second return valve 97*b* as the return valves is opened, supplies the liquid pressurized by the supply pump 39A to the pressure adjustment mechanism 48 and the liquid ejecting portion 15, and performs the pressurization discharge operation of discharging the liquid from the nozzle 24 by pressurizing the liquid in the liquid ejecting portion 15 including the common liquid chamber 85. Subsequently, the control portion 111 closes the first return valve 97*a* and the second return valve 97*b* and closes the supply valve 59 to stop the pressurization discharge operation and perform the pressure lowering operation. Also in this case, since the pressure lowering operation is performed in the state where the flow of the liquid in the liquid return flow path 31 is blocked, it is possible to reduce the inflow of the liquid containing a foreign matter or a different type of liquid adhering to the nozzle surface 25 into the liquid return flow path 31 via the liquid ejecting portion 15.

The liquid ejecting apparatus may not include a supply-side flow mechanism. For example, in Embodiment 1, when the liquid ejecting apparatus 11 does not include the supply pump 39A as the supply-side flow mechanism among the flow mechanisms 39, the control portion 111 may flow the liquid in the supply direction A from the liquid storage portion 32 toward the liquid ejecting portion 15 in the liquid supply flow path 30 by driving the flow-out pump 34. In this case, the flow-out pump 34 can be applied as a pressurization mechanism capable of pressurizing the liquid in the liquid ejecting portion 15 including the common flow path. In addition, when the supply valve 59 is in the valve-closed state in the pressure adjustment mechanism 48, the control portion 111 may set the pressure in the liquid upstream of the pressure adjustment mechanism 48 to a positive pressure higher than the atmospheric pressure by driving the flow-out pump 34. In addition, at this time, it is preferable to close the storage release valve 41 of the liquid storage portion 32.

The liquid ejecting apparatus may not include a liquid storage portion. For example, in Embodiment 1, the liquid ejecting apparatus 11 may not include the liquid storage portion 32, and the liquid return flow path 31 may couple the second discharge port 96*b* as a discharge port and the coupling portion between the supply pump 39A as the supply-side flow mechanism in the liquid supply flow path 30 and the on-off valve 45, so that the liquid supplied to the liquid ejecting portion 15 can be returned to the liquid supply flow path 30. In addition, in this case, the liquid ejecting apparatus 11 may not include the return pump 39B as the return-side flow mechanism, and the control portion 111 may flow the liquid in the supply direction A and the return direction B in the circulation route 33 by driving the supply pump 39A in a state where the first return valve 97*a* and the second return valve 97*b* as the return valves are opened and the on-off valve 45 is closed. In addition, the control portion 111 may flow the liquid in the supply direction A in the liquid supply flow path 30 to pressurize the liquid in the liquid supply flow path 30 by driving the supply pump 39A in a state where the first return valve 97*a* and the second return valve 97*b* as the return valves are closed and the on-off valve 45 is opened. The control portion 111 may perform the pressurization discharge operation by opening the supply valve 59.

In the liquid ejecting apparatus, for example, in Embodiment 1, the control portion 111 may cause the liquid to flow in the supply direction A and the return direction B in the circulation route 33 by driving the return pump 39B, in a state where the first return valve 97*a* and the second return valve 97*b* as the return valves are opened, abruptly close the first return valve 97*a* and the second return valve 97*b* to block the flow of the liquid, and perform the pressurization discharge operation by pressurizing the pressure in the liquid ejecting portion 15.

The liquid ejecting apparatus 11 may include a pressure sensor capable of detecting the common flow path internal pressure, which is the pressure inside the common liquid chamber 85, as in Embodiment 4, as the pressure regulation device 40, and a control valve capable of controlling the valve-opened state that allows the flow of liquid and the valve-closed state that blocks the flow of the liquid in the liquid supply flow path 30, as the pressure regulation device 40. The control valve may be an electromagnetic valve such as a solenoid valve. In this case, the control portion 111 may open and close the control valve so that the common flow path internal pressure detected by the pressure sensor is within the range of the discharge pressure. In addition, the control portion 111 may perform the pressurization discharge operation by opening the control valve, and may perform the pressure lowering operation by opening the control valve to stop the pressurization discharge operation.

The liquid ejecting apparatus 11 may not include an expansion and contraction portion 67 in the pressing mechanism 49, and may open and close the supply valve 59 by regulating the pressure in the air chamber 72 directly coupled to the coupling route 75 by the pressure regulation portion 69. In this case, the control portion 111 may open the supply valve 59 to perform the pressurization discharge operation by driving the pressurization pump 74 of the pressure regulation portion 69 to increase the pressure in the air chamber 72, may open the supply valve to stop the pressurization discharge operation by driving the fluid pressure regulation portion 77 of the pressure regulation portion 69 to lower the pressure in the air chamber 72, and may start the pressure lowering operation. In addition, the pressurization pump 74 is made capable of sucking the air in the air chamber 72, and the control portion 111 drives the fluid pressure regulation portion 77 of the pressure regulation portion 69 to lower the pressure in the air chamber 72 in the pressure lowering operation. Therefore, the lowering of the pressure in the liquid ejecting portion 15 in the pressure lowering operation may be promoted.

The liquid ejecting apparatus may include a pressure regulating valve as a return valve provided in the liquid return flow path. For example, in Embodiment 5, the liquid ejecting apparatus 611 may be provided in the liquid return flow path so that the first return valve 97*a* and the second return valve 97*b* as the return valves have the same configuration as that of the pressure adjustment mechanism 48, the liquid flows into the liquid inflow portion from the discharge port of the liquid ejecting portion 15, and the liquid outflow portion is downstream from the liquid inflow portion in the return direction B in the liquid return flow path. Accordingly, when the liquid does not flow in the return direction B by driving the return-side flow mechanism, since the return valve does not open, the control portion 111 can perform the pressurization discharge operation in a state where the flow of the liquid in the liquid return flow path is blocked, by driving and controlling the pressurization mechanism. In addition, when the liquid supplied to the liquid ejecting portion 15 is returned to the liquid supply flow path 30, for example, when the control portion 111 drives the first return pump 39Ba as the return-side flow mechanism, the pressure in the first return flow path 31*a* decreases, so that the first return valve 97*a* opens, and the liquid in the liquid ejecting portion 15 is returned to the liquid supply flow path 30 via the first return flow path 31*a* In addition, the pressure in the liquid outflow portion where the return valve opens may be set so that the negative pressure is smaller than the pressure at which the recessed meniscus formed in the nozzle 24 breaks, and the negative pressure is larger than the pressure at which the supply valve 59 opens, for example, a gauge pressure in the range of −2 kPa to −3 kPa. Accordingly, for example, when the control portion 111 drives the second return pump 39Bb as the return-side flow mechanism, the supply valve 59 and the second return valve 97*b* are opened, and the liquid supplied from the liquid supply flow path 30 to the liquid ejecting portion 15 is returned to the liquid supply flow path 30 via the second return flow path 31*b*.

In the pressure lowering operation of the second embodiment, the liquid ejecting apparatus may perform the pressure lowering flushing until the common flow path internal pressure is negative pressure, or until the common flow path internal pressure is within the range of the discharge pressure. For example, in the pressure lowering operation, the control portion 111 performs the pressure lowering flushing until it is estimated that a recessed meniscus is formed in the nozzle 24 from the vibration waveform of the individual liquid chamber 86 detected by the ejection state detection portion 113, and ends the pressure lowering operation. When the pressure lowering flushing is performed until the common flow path internal pressure is within the range of the discharge pressure, the common flow path internal pressure after the pressure lowering operation is lower than the common flow path internal pressure in the pressurization discharge operation and is the same as the discharge pressure.

In the pressure lowering operation of the third embodiment, the liquid ejecting apparatus may perform the pressure lowering wiping operation until the common flow path internal pressure is negative pressure, or until the common flow path internal pressure is within the range of the discharge pressure. For example, in the pressure lowering operation, the control portion 111 performs the pressure lowering wiping operation until it is estimated that a recessed meniscus is formed in the nozzle 24 from the vibration waveform of the individual liquid chamber 86 detected by the ejection state detection portion 113, and ends the pressure lowering operation. When the pressure lowering wiping operation is performed until the common flow path internal pressure is within the range of the discharge pressure, the common flow path internal pressure after the pressure lowering operation is lower than the common flow path internal pressure in the pressurization discharge operation and is the same as the discharge pressure.

In the liquid ejecting apparatus, the drive specifications in the finish flushing operation may be different from the drive specifications of the discharge element 89 in the flushing operation as the second discharge operation performed during the printing treatment, or may be different from the drive specification of the discharge element 89 in the pressure lowering flushing operation. As a result, for example, the size of the droplets discharged in the finish flushing operation may be smaller than the size of the droplets discharged in the flushing operation as the second discharge operation, and may be larger than the size of the droplets discharged in the pressure lowering flushing operation. In addition, for example, the discharge speed of the droplets discharged in the finish flushing operation may be faster than the discharge speed of the droplets discharged in the flushing operation as the second discharge operation, and may be slower than the discharge speed of the droplets discharged in the pressure lowering flushing operation.

The liquid ejecting apparatus may be provided with a temperature sensor capable of detecting the temperature of the liquid in the liquid ejecting portion. For example, the liquid ejecting portion 15 of the liquid ejecting apparatus 11 may be provided with, for example, a temperature sensor capable of detecting the temperature in the common liquid chamber 85 or the individual liquid chamber 86, and the control portion 111 may estimate the viscosity in the individual liquid chamber 86 and the nozzle 24 communicating with the common liquid chamber 85 from the temperature of the liquid in the liquid ejecting portion 15 detected by the temperature sensor.

The liquid ejecting apparatus may be provided with an electric heat conversion element such as a heater capable of heating the liquid in the individual liquid chamber 86, as a discharge element provided in the liquid ejecting portion. For example, the control portion 111 of the liquid ejecting apparatus 11 may eject the liquid from the nozzle 24 by driving the heater of the liquid ejecting portion 15 to heat the liquid in the individual liquid chamber 86 to cause film boiling. In this case, the ejection state detection portion 113 may compare the maximum temperature at the time of liquid ejection detected by the temperature detection element directly provided under the heater with a predetermined threshold value, or may detect the ejection state from the difference in temperature change. In addition, the ejection state detection portion 113 may detect the ejection state by the flight detection by the optical element. The control portion 111 may estimate the liquid ejection state of the liquid ejecting portion 15 by combining the results of the state detection in the individual liquid chamber 86 and the flight detection by the optical element.

What is claimed is:

1. A liquid ejecting apparatus comprising:

a liquid ejecting portion configured to eject liquid;

a pressurizing mechanism configured to pressurize an inside of the liquid ejecting portion, wherein the pressurizing mechanism includes a liquid outflow portion having a flexible portion formed by a flexible member, the liquid ejecting portion includes a first liquid ejecting portion and a second liquid ejecting portion, the liquid outflow portion includes a first liquid outflow portion communicating with the first liquid ejecting portion and a second liquid outflow portion communicating with the second liquid ejecting portion, the first liquid outflow portion includes a first flexible portion, the second liquid outflow portion includes a second flexible portion, and the pressurizing mechanism changes a volume of the first liquid outflow portion and a volume of the second liquid outflow portion via one closed space.

2. The liquid ejecting apparatus according to claim 1, wherein the pressurizing mechanism includes a pressure regulation portion configured to change a pressure in the closed space, and wherein the inside of the liquid ejecting portion is pressurized due to the volume change of the liquid outflow portion accompanying the pressure change in the closed space by the pressure regulation portion.

3. The liquid ejecting apparatus according to claim 2, wherein the liquid outflow portion is configured to stores the liquid, and wherein the pressurizing mechanism pressurizes the inside of the liquid ejecting head by supplying the liquid from the liquid outflow portion to the liquid ejecting portion.

4. The liquid ejecting apparatus according to claim 2, further comprising:

a liquid supply source that stores the liquid to be supplied to the liquid ejecting portion; and a liquid supply flow path coupling the liquid supply source and the liquid ejecting portion, wherein the liquid outflow portion is a part of a liquid supply flow path.

5. The liquid ejecting apparatus according to claim 4, further comprising:

a valve provided in the liquid supply flow path between the liquid supply source and the liquid outflow portion, wherein the valve is configured to close the liquid supply flow path when the inside of the liquid ejecting portion is pressurized by the pressurizing mechanism.

6. The liquid ejecting apparatus according to claim 5, wherein the liquid ejecting portion is configured to eject the liquid from a plurality of nozzles, and wherein the liquid ejecting portion discharges the liquid from the plurality of nozzles by the pressurization of the pressurizing mechanism.

7. The liquid ejecting apparatus according to claim 6, further comprising:

a cap configured to contact the liquid ejecting portion, wherein the cap receives the liquid discharged from the plurality of nozzles.

8. A maintenance method of a liquid ejecting apparatus including a liquid ejecting portion configured to eject liquid, a pressurizing mechanism configured to pressurize an inside of the liquid ejecting portion, wherein the pressurizing mechanism includes a liquid outflow portion having a flexible portion formed by a flexible member, the liquid ejecting portion includes a first liquid ejecting portion and a second liquid ejecting portion, the liquid outflow portion includes a first liquid outflow portion communicating with the first liquid ejecting portion and a second liquid outflow portion communicating with the second liquid ejecting portion, the first liquid outflow portion includes a first flexible portion, and the second liquid outflow portion includes a second flexible portion, the maintenance method comprising:

pressurizing an inside of the liquid ejecting portion by changing a volume of the first liquid outflow portion and a volume of the second liquid outflow portion via one closed space.

* * * * *